US009776071B2

(12) United States Patent
Amireh et al.

(10) Patent No.: US 9,776,071 B2
(45) Date of Patent: Oct. 3, 2017

(54) RESONANT COILS FOR USE WITH GAMES AND TOYS

(71) Applicant: Mattel, Inc., El Segundo, CA (US)

(72) Inventors: Nicholas S. Amireh, Los Angeles, CA (US); Vladimir Buzga, Torrance, CA (US); Vladimir Sosnovskiy, North Hollywood, CA (US)

(73) Assignee: Mattel, Inc., El Segundo, CA (US)

( * ) Notice: Subject to any disclaimer, the term of this patent is extended or adjusted under 35 U.S.C. 154(b) by 720 days.

(21) Appl. No.: 14/274,574

(22) Filed: May 9, 2014

(65) Prior Publication Data

US 2014/0333025 A1 Nov. 13, 2014

Related U.S. Application Data

(60) Provisional application No. 61/821,551, filed on May 9, 2013.

(51) Int. Cl.

| | |
|---|---|
| ***A63F 1/02*** | (2006.01) |
| *A63F 3/00* | (2006.01) |
| *A63F 9/24* | (2006.01) |

(52) U.S. Cl.

CPC ..... *A63F 1/02* (2013.01); *A63F 2003/00665* (2013.01); *A63F 2009/2488* (2013.01); *A63F 2009/2489* (2013.01)

(58) Field of Classification Search

None

See application file for complete search history.

(56) References Cited

U.S. PATENT DOCUMENTS 5,082,286 A * 1/1992 Ryan ..... A63F 3/00643 273/238
6,412,779 B1 * 7/2002 Kenney ..... A63F 1/04 273/274

(Continued)

FOREIGN PATENT DOCUMENTS

ES 2422056 A2 9/2013
GB 2502182 A 11/2013

(Continued)

OTHER PUBLICATIONS

Thomas Guthrie Zimmerman, Personal Area Networks (PAN): Near-Field Intra-Body Communication, Oct. 26, 1995, 81 pages, only viewable online at http://dspace.mit.edu/bitstream/handle/1721.1/29101/34289663.pdf.

(Continued)

*Primary Examiner* — Milap Shah
*Assistant Examiner* — Robert T Clarke, Jr.
(74) *Attorney, Agent, or Firm* — Kolisch Hartwell, P.C.

(57) ABSTRACT

An electronic card game system and method using NFC or RFID electromagnetic communication, including an initiator having a driving coil, a first card having a secondary coil with a capacitor, and a playing piece having a receiving coil. The initiator and the first card may be placed on a playing surface so that at least a portion of the driving coil and at least a portion of the secondary coil overlap. Similarly, the first card and the playing piece may be placed on a playing surface so that at least a portion of the receiving coil and at least a second portion of the secondary coil overlap. These overlapped coils allow a driving signal initiated at the driving coil to be transmitted through the secondary coil and received by the receiving coil.

17 Claims, 17 Drawing Sheets

(56) References Cited

U.S. PATENT DOCUMENTS

| | | | | |
|---|---|---|---|---|
| RE37,957 | E | 1/2003 | Garfield | |
| 6,761,637 | B2 | 7/2004 | Weston | |
| 6,773,325 | B1 | 8/2004 | Mawle | |
| 6,835,131 | B1 | 12/2004 | White | |
| 6,967,566 | B2 | 11/2005 | Weston | |
| 7,033,243 | B2 | 4/2006 | Hornsby | |
| 7,081,033 | B1 | 7/2006 | Mawle | |
| 7,338,377 | B2 | 3/2008 | Shinoda | |
| 7,392,985 | B1 | 7/2008 | Lam | |
| 7,409,466 | B2 | 8/2008 | Yang | |
| 7,791,483 | B2 | 9/2010 | Oberle | |
| 7,828,295 | B2 | 11/2010 | Matsumoto | |
| 7,843,471 | B2 | 11/2010 | Doan | |
| 7,883,420 | B2 | 2/2011 | Bradbury | |
| 7,952,322 | B2 | 5/2011 | Partovi | |
| 8,025,573 | B2 | 9/2011 | Stenton | |
| 8,033,901 | B2 | 10/2011 | Wood | |
| 8,104,688 | B2 | 1/2012 | Wallace | |
| 8,128,089 | B2 | 3/2012 | Erickson | |
| 8,169,185 | B2 | 5/2012 | Partovi | |
| 8,282,101 | B2 | 10/2012 | Snoddy | |
| 8,303,389 | B2 | 11/2012 | Wilm | |
| 8,333,382 | B2 * | 12/2012 | Willard | A63F 3/0023 273/285 |
| 8,353,759 | B2 | 1/2013 | Thorson | |
| 8,602,857 | B2 | 12/2013 | Morichau-Beauchant | |
| 2002/0052238 | A1 | 5/2002 | Muroi | |
| 2004/0166913 | A1 | 8/2004 | Shinoda | |
| 2005/0059483 | A1 | 3/2005 | Borge | |
| 2006/0001211 | A1 | 1/2006 | Lewis | |
| 2006/0031119 | A1 | 2/2006 | Sellen | |
| 2006/0116192 | A1 | 6/2006 | Okada | |
| 2007/0015588 | A1 | 1/2007 | Matsumoto | |
| 2007/0052167 | A1 | 3/2007 | Galatan | |
| 2007/0087837 | A1 | 4/2007 | Bradbury | |
| 2007/0117602 | A1 | 5/2007 | Madigou | |
| 2007/0202952 | A1 | 8/2007 | Francis | |
| 2007/0211047 | A1 | 9/2007 | Doan | |
| 2008/0081694 | A1 | 4/2008 | Hong | |
| 2008/0085773 | A1 | 4/2008 | Wood | |
| 2008/0297317 | A1 | 12/2008 | Oberle | |
| 2009/0102120 | A1 | 4/2009 | Hou | |
| 2009/0197658 | A1 | 8/2009 | Polchin | |
| 2009/0305758 | A1 | 12/2009 | Nomura | |
| 2009/0315257 | A1 | 12/2009 | Blumenstock | |
| 2009/0315258 | A1 | 12/2009 | Wallace | |
| 2010/0032900 | A1 * | 2/2010 | Wilm | A63F 3/00643 273/237 |
| 2010/0096805 | A1 * | 4/2010 | Bishai | A63F 3/00 273/260 |
| 2010/0198428 | A1 | 8/2010 | Sultan | |
| 2010/0201069 | A1 | 8/2010 | Lam | |
| 2011/0089634 | A1 | 4/2011 | Thorson | |
| 2011/0098092 | A1 | 4/2011 | Reiche, III | |
| 2011/0161093 | A1 | 6/2011 | Ganz | |
| 2011/0204565 | A1 | 8/2011 | Gelinotte | |
| 2012/0032632 | A1 | 2/2012 | Soar | |
| 2012/0049453 | A1 | 3/2012 | Morichau-Beauchant | |
| 2012/0075148 | A1 | 3/2012 | Cho | |
| 2012/0077584 | A1 | 3/2012 | Sarmenta | |
| 2012/0077593 | A1 | 3/2012 | Sarmenta | |
| 2012/0158353 | A1 | 6/2012 | Sosnovskiy | |
| 2012/0208459 | A1 | 8/2012 | Burtt | |
| 2012/0209744 | A1 | 8/2012 | Mullen | |
| 2012/0256585 | A1 | 10/2012 | Partovi | |
| 2012/0286936 | A1 | 11/2012 | Mullen | |
| 2012/0295699 | A1 | 11/2012 | Reiche | |
| 2012/0295700 | A1 | 11/2012 | Reiche | |
| 2012/0295703 | A1 | 11/2012 | Reiche | |
| 2012/0295704 | A1 | 11/2012 | Reiche | |
| 2012/0295714 | A1 | 11/2012 | Reiche | |
| 2013/0005243 | A1 | 1/2013 | Royston | |
| 2013/0231191 | A1 | 9/2013 | Rodriguez Machado | |

FOREIGN PATENT DOCUMENTS

| | | | |
|---|---|---|---|
| JP | 06259183 | | 9/1994 |
| JP | 2003047771 | A | 2/2003 |
| JP | 2011244537 | A | 12/2011 |
| WO | 0148580 | A2 | 7/2001 |
| WO | 0247013 | A2 | 6/2002 |
| WO | 03043709 | A1 | 5/2003 |
| WO | 2005039714 | A2 | 5/2005 |
| WO | 2006036851 | A2 | 4/2006 |
| WO | 2006038905 | A1 | 4/2006 |
| WO | 2006061393 | A2 | 6/2006 |
| WO | 2008016273 | A1 | 2/2008 |
| WO | 2009033043 | A2 | 3/2009 |
| WO | 2009050625 | A2 | 4/2009 |
| WO | 2010136928 | A1 | 12/2010 |
| WO | 2012158836 | A2 | 11/2012 |

OTHER PUBLICATIONS

Texas Instruments, HF Antenna Cookbook, Technical Application Report, Jan. 31, 2004, 29 pages.

Ziv Kfir and Avishai Wool, Picking Virtual Pockets using Relay Attacks on Contactless Smartcard Systems, Dec. 31, 2005, 12 pages.

Han Kirschenbaum and Avishai Wool, How to Build a Low-Cost, Extended-Range RFID Skimmer, Dec. 31, 2006, 15 pages.

Pulse Electronics/Larsen Antennas, NFC Antenna Solutions, Sep. 30, 2012, 2 pages.

Wikipedia, Skylanders: Spyro's Adventure, Nov. 29, 2012, 7 pags.

Mark Roberti, The History of RFID Technology, Feb. 7, 2013, 3 pages.

antennatheory.com, NFC Antennas, Feb. 21, 2013, 3 pages.

Innovision Research & Technology, Near Field Communication in the real world, Feb. 21, 2013, 13 pages.

T.G. Zimmerman, Personal Area Networks: Near-field intrabody communication, Dec. 31, 1996, 9 pages.

* cited by examiner

RESONANT COILS FOR USE WITH GAMES AND TOYS

CROSS-REFERENCE TO RELATED APPLICATIONS

This application claims priority to U.S. Provisional Patent Application Ser. No. 61/821,551 and entitled RESONANT COILS FOR USE WITH GAMES AND TOYS, the disclosure of which is incorporated herein by reference.

FIELD OF THE DISCLOSURE

This disclosure relates to electronic toys and games. More particularly, this disclosure relates to card-like resonant coils used with toys and games that employ NFC and/or RFID technologies, for example, to provide power to game components and/or read data from game components.

BACKGROUND OF THE DISCLOSURE

Near Field Communications (NFC) refers to a technology that allows radio-frequency devices such as mobile phones to establish wireless communications over short distances, typically within a few centimeters. For example, an NFC-enabled mobile phone may read data from other NFC-enabled devices in close proximity, without direct contact. Radio-Frequency Identification (RFID) refers to a similar technology that enables wireless data transfer. For example, an RFID reader may read data from an RFID tag attached to an object, e.g., to identify a product in an inventory control system. Electronic toys and games may employ NFC and/or RFID technologies to read data over short distances. For example, a game console may read data from a trading card that contains an NFC tag.

Examples of such systems are found in the "SKYLANDERS" games, as disclosed in US patent applications US20110098092; US20120295699; US20120295700; US20120295703; US20120295704; and US20120295714. Other examples are disclosed in US patent applications US20020052238, US20020077182, US20040152521, US20040214642, US20050143173; US20130231191; US20130249301; U.S. Pat. No. 4,764,666, U.S. Pat. No. 5,190,285, U.S. Pat. No. 5,689,561, U.S. Pat. No. 5,743,801, U.S. Pat. No. 5,853,327, U.S. Pat. No. 6,161,762, U.S. Pat. No. 6,200,216, U.S. Pat. No. 6,468,162, U.S. Pat. No. 6,761,637, U.S. Pat. No. 6,773,325, U.S. Pat. No. 7,018,213, U.S. Pat. No. 7,057,492, U.S. Pat. No. 7,081,033, and U.S. Pat. No. 8,602,857; International patent publication WO2006036851; European patent application EP0492569; and Japanese patent application JP07323159. The disclosures of these and all other publications referenced herein are incorporated by reference in their entirety for all purposes. In the event that any of the incorporated references listed in the previous paragraph define a term or terms in a manner inconsistent with either the disclosure of the present application or with any of the other incorporated references, the term or terms as used therein only control with respect to the patent document in which the term or terms are defined. Stated differently, a patentee of any one of the aforementioned incorporated references listed in the previous paragraph, when acting as his/her own lexicographer, does so only with respect to the reference in which the term or terms are defined. Accordingly, any such defined term or terms do not, in any way, define the same or similar term or terms used in the present application or in any of the other aforementioned or later-mentioned references.

DETAILED DESCRIPTION OF THE DISCLOSURE

Examples of an electronic game system according to the present disclosure are shown in FIGS. 1-13. Unless otherwise specified, an electronic game system may, but is not required to, contain at least one of the structure, components, functionality, and/or variations described, illustrated, and/or incorporated herein.

This disclosure describes electronic games that use inductive coils to transmit power signals and/or data signals between a powered device, such as a mobile phone, and a game component, such as a game piece. Preferably, the inductive coils are formed as part of playing cards, used in connection with playing a game. The inductive coils, when properly located and oriented, transmit the signals without direct contact between the powered device and the game component, creating a magical and fun play pattern for the game. The inductive coils function as an inductive bridge between components, and enable effects that surprise, reward, or punish players of the game.

Figure 1A:
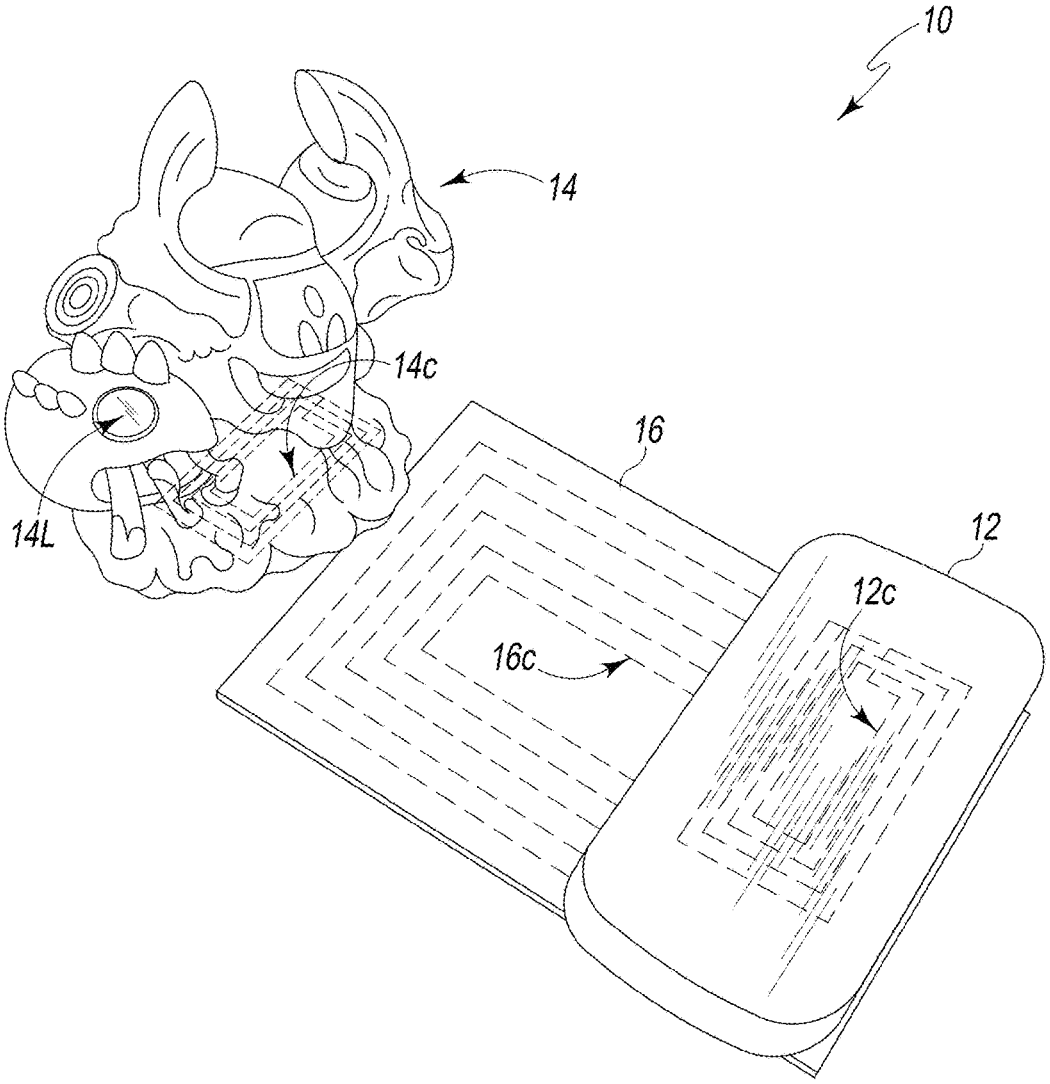
FIGS. 1A-C show one embodiment of an electronic game or toy system according to this disclosure that includes a powered base station (a mobile phone), a game piece, and a resonant card (a game board).
Figure 1B:
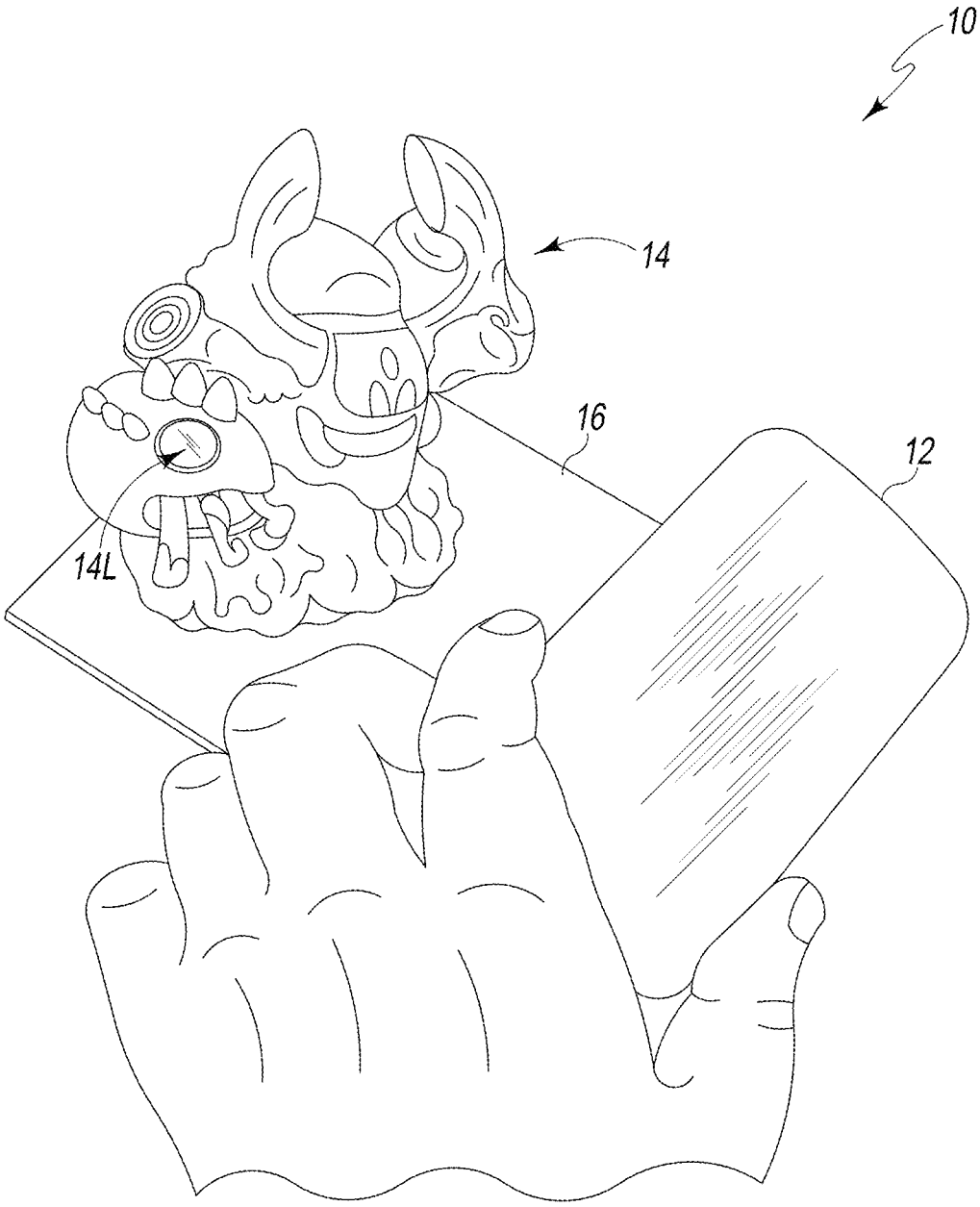
Figure 1C:
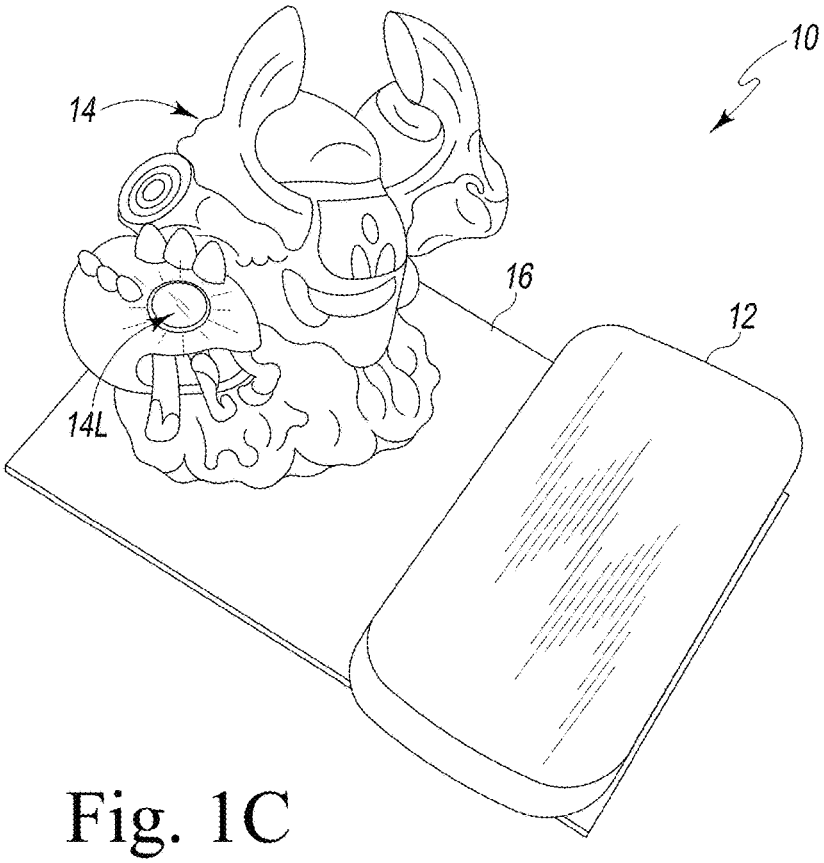

FIGS. 1A-1C are drawings of one embodiment of a game system 10, including a powered base station 12 (shown here as a mobile phone) that energizes a driving coil 12*c* to transmit data signals and power signals to a game piece 14 including a receiving coil 14*c*. More specifically, the signals are transmitted from base station 12 to game piece 14 through a game board 16 that includes a resonant coil 16*c*. One such coil is shown schematically in FIG. 1D. An output may be produced at game piece 14, as demonstrated in FIG. 1C, with an illuminated light, 14L. In this embodiment, game piece 14 acts as a goal or target, located at a distance from base station 12. "Electronic game system 10" may sometimes be referred to in the present disclosure as an "electronic card game system" or a "system." Additionally, "powered base station 12" may sometimes be referred to in the present disclosure as an "initiator device," an "initiator," a "device," or a "two-way radio." Additionally, "game piece 14" may sometimes be referred to in the present disclosure as a "target," a "target device," a "device," a "piece," or a "transponder."

Figure 2A:
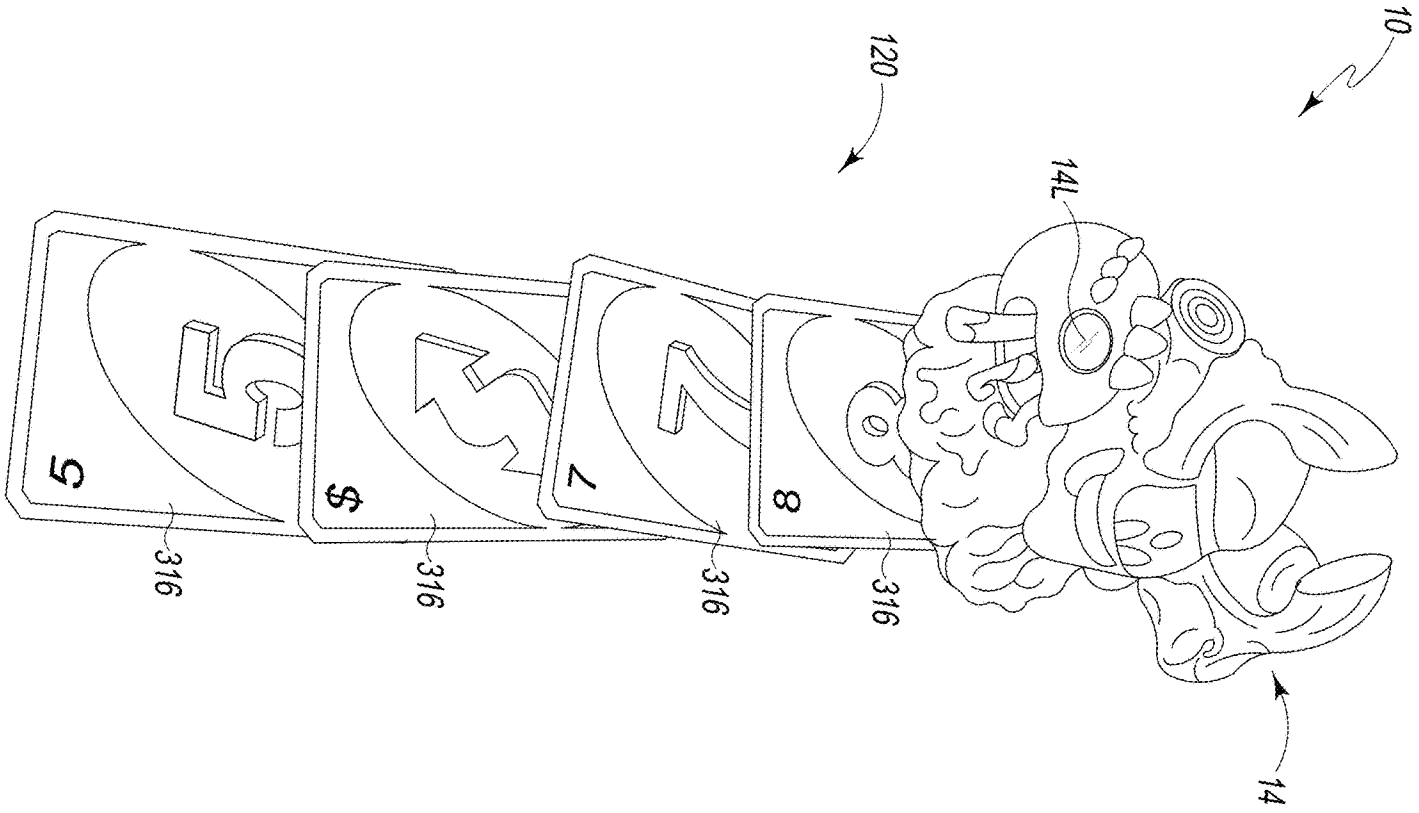
FIGS. 2A-B show another representative embodiment of an electronic game system according to this disclosure that includes a plurality of resonant cards (playing cards) arranged in an overlapping series.
Figure 2B:
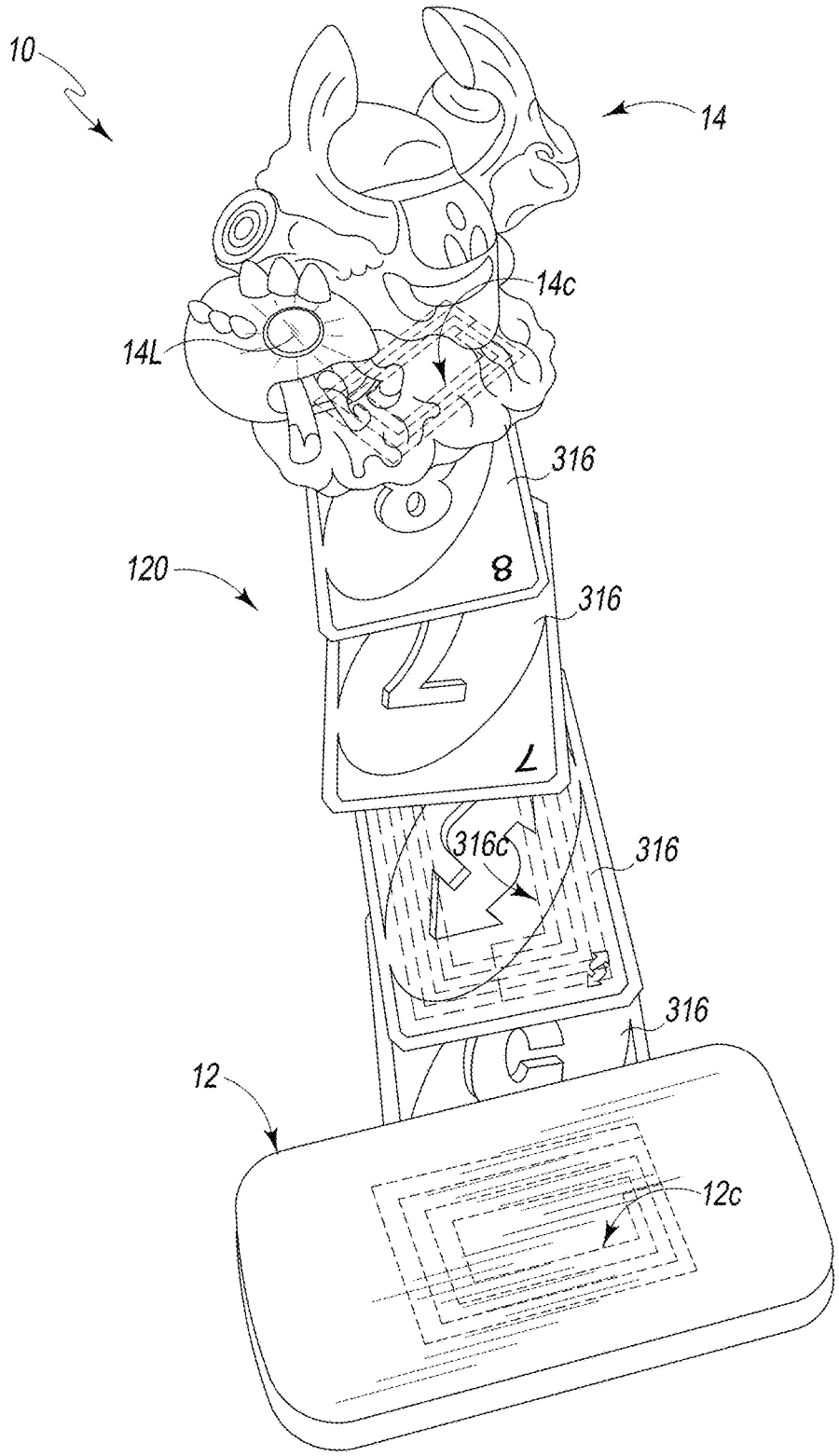

FIGS. 2A and 2B show a slightly different embodiment, in which a series or array 120 of playing cards 316 are shown being used with the same base station 12 and game piece 14 of FIGS. 1A-1C. It will be noted that playing cards 316 are sized slightly smaller than game board 16, and that the smaller playing cards 316 have been arranged in an overlapping series, advancing from base station 12, shown in FIG. 2B, toward game piece 14. When base station 12 is placed above one of playing cards 316, and additional playing cards 316 overlap to form a line of uninterrupted overlapping cards, this line of cards 316 bridges a distance from base station 12 to game piece 14, and activates the "goal," as demonstrated by illumination of light 14L.

In both of these embodiments, the coils of playing card 16, or the coils of a set of playing cards 316, may enable games that use a mobile phone to energize game pieces and/or communicate with game pieces to read data stored in the game pieces. This energization and communication occurs inductively, which allows a base station 12 to provide power to and/or read data from a remote game piece 14.

In FIG. 2B, a few of the coils are shown, as broken line schematics. Powered base station 12 includes a driving coil 12*c*. Game piece 14 includes a receiving coil 14*c*. Each of the playing cards 316 includes a resonant coil 316*c*. For simplicity of the drawing only one of cards 316 is shown with coil 316*c* in broken lines.

In other embodiments, not shown, a game may include a base station that energizes a primary coil, a game board that contains a passive, resonant coil that extends from an area under the base station to a "winner's circle" area, and a set of game pieces in which each piece contains a passive, receiving coil. When a player's game piece reaches the winner's circle, the coil in the base station energizes the coil in the game board which in turn energizes the coil in the winner's game piece, activating the winner's game piece.

Inductive communication via wireless technologies in a handheld device such as a mobile phone is known, using Near Field Communications (NFC) or Radio Frequency Identification (RFID) via directional transceivers. Such communication generally works only over short distances, e.g., up to a few centimeters. NFC and RFID further may require a particular alignment and a close proximity between the communicating devices. The subject of the present disclosure allows playing cards to extend or modify the distances, directions, and alignments for power or data exchange via NFC and/or RFID technologies, permitting novel arrangements as part of an electronic toy or electronic game system.

Figure 3:
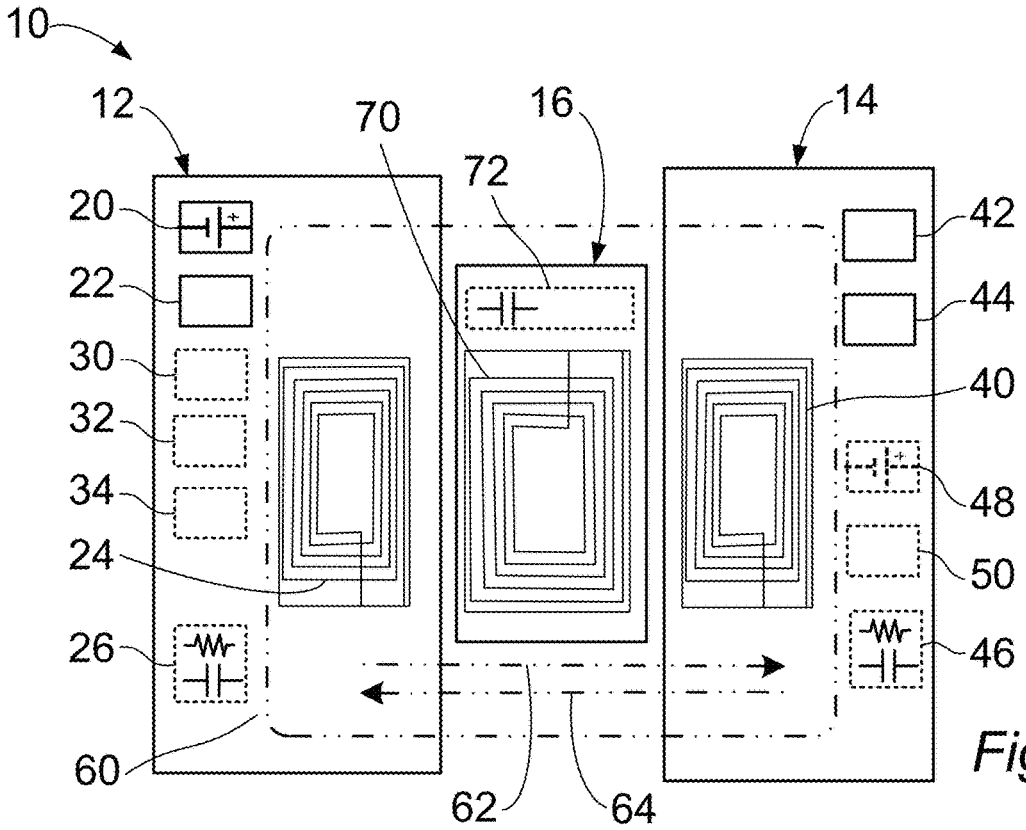
FIG. 3 shows a block diagram of an electronic game system in which illustrative embodiments may be illustrated.
Figure 4:
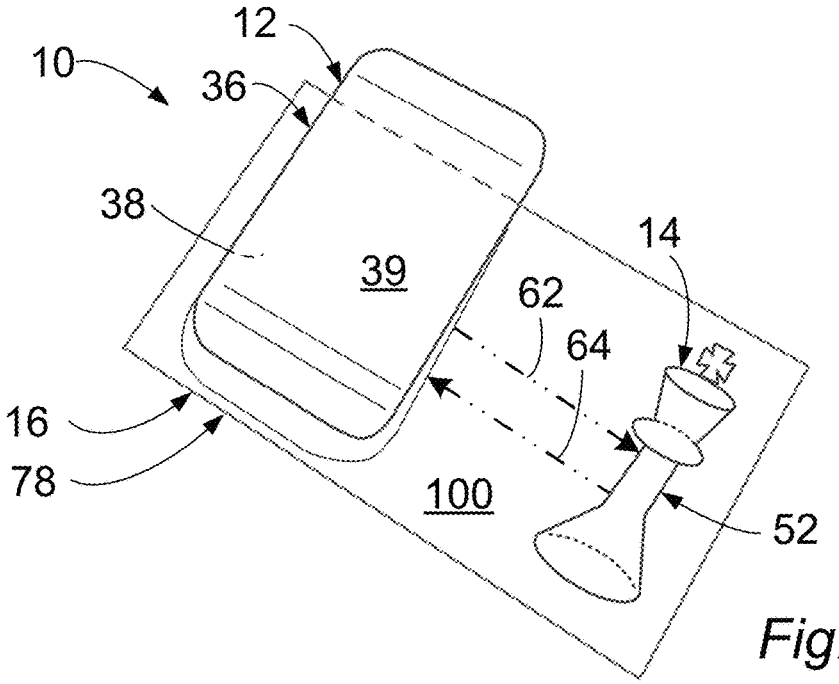
FIG. 4 shows a perspective view of an exemplary electronic game system in accordance with this disclosure that includes an initiator device disposed in a mobile phone, a target device disposed in a game piece, and a resonant card disposed in a game board.

FIGS. 3 and 4 show a schematic representation of the electronic toy or game system 10 shown in FIG. 1C. System 10 may include an initiator device 12, a target device 14, and one or more resonant cards 16. System 10 may include other, alternative, or additional elements and may omit one or more of the listed elements.

Initiator device 12 may be any NFC or RFID device that generates an electro-magnetic (EM) radio-frequency (RF) field that can provide power to a target 14 and/or receive data from a target 14. Initiator 12 may include a power source 20, a communications system 22, and a primary coil 24. Initiator 12 may further include electrical components 26, a display system 30, a control system 32, application software 34, and/or functional or decorative form 36. Initiator 12 may have a first face 38 proximate coil 24 and a second face 39 opposite coil 24. Examples of initiator devices 12 include NFC- or RFID-enabled cell phones, smart phones, tablets, personal computers; available or custom NFC- or RFID-readers; and game components designed to act as initiators. Initiator 12 may include other, alternative, or additional elements and may omit one or more of the listed elements.

Power source 20 may be any electrical power supply sufficient to operate initiator 12. For example, if initiator 12 is included in an NFC-enabled mobile phone, then power source 20 may be a battery that energizes the phone.

Communications system 22 may include any hardware or software appropriate for implementing wireless data transfer according to a selected NFC or RFID standard. For example, initiator 12 may include one or more integrated circuits that generate, receive, and process NFC or RFID signals.

Primary coil 24 may be or include an NFC or RFID transducer. For example, coil 24 may be an inductor, e.g., a coiled conductor that converts an electrical signal to EM RF field 60 and vice versa. Field 60, coupled to another inductor, e.g., receiving coil 40, enables initiator 12 to supply power and data to target 14 and receive data from target 14. The number of turns in coil 24, its dimensions, and other properties may be selected to match an applicable NFC or RFID frequency. Coil 24 may be manufactured by various techniques including circuit printing techniques. Coil 24 may have associated electronic parts, e.g., capacitors and/or resistors, e.g., to tune the response of coil 24. Coil 24 may be referred to as a driving coil 24.

Coil 24 may function as a directional antenna. For example, an initiator 12 included in a mobile phone may include a primary coil 24 proximate the first face 38 (i.e., its back side) of the phone and configured to direct field 60 preferentially away from second face 39. This directionality may focus field 60 toward a region adjacent first face 38, e.g., to allow an NFC reader in the phone to efficiently read data from a region at the back of the phone. Coil 24 accordingly may transmit field 60 primarily on the first face 38 of initiator 12.

Initiator 12 may have associated electronic or electronic components 26, e.g., one or more resistors and/or capacitors connected in series or parallel to primary coil 24, e.g., to implement an RLC circuit.

Display system 30 may include any mechanism that provides output to a user of initiator 12. For example, if initiator 12 is a mobile phone, then display 30 may include features provided by the phone, e.g., its screen, speaker, vibration motor, etc. For example, if initiator 12 is a base station of a board game, then display 30 may include associated light sources, buzzers, etc. Display 30 may be used to provide information or feedback to a user playing a toy or game. Initiator 12 may omit display 30. For example, a game piece may include a hidden initiator 12 and omit display 30.

Control system 32 may include any device or mechanism that allows a user to provide input to initiator 12. For example, if initiator 12 is a mobile phone, then any key, button, touch-screen, or GPS feature of the phone may function as a control, e.g., to allow a user to interact with a game. Initiator 12 may omit control system 32. For example, a hidden initiator may operate without user input and omit control system 32.

Application software 34 may include any user-accessible program executing on initiator 12. For example, initiator 12 may be a smart phone that runs software 34 (an app) that implements a game that includes NFC or RFID features. Software 34 may employ cellular telephone, Wi-Fi, or other communications services of initiator 12, e.g., to implement multi-player games or communicate with central servers.

Initiator 12 may have associated mechanical, functional, or decorative elements, collectively indicated as form 36. For example, an initiator 12 housed in a base station may include parts that provide electrical insulation and mechanical support. Form 36 may provide a fanciful aspect of a game, e.g., molded skins decorated to fit the theme of the game. Form 36 may exhibit any three-dimensional shape, e.g., approximately planar, cuboid, spheroid, humanoid, fanciful, or irregular.

Target device 14 may be any NFC- or RFID-compatible device that receives power from and/or returns data to initiator 12. For example, when target 14 is interrogated by initiator 12, target 14 may return stored data to initiator 12. Target 14 may include a receiving coil 40, a communications system 42, and a memory 44. Target 14 may be or include an NFC or RFID tag, sticker, or chip that may package coil 40, communications system 42, and/or memory 44 as a unit. Target 14 may further include electrical components 46, a power source 48, and/or a powered device 50. Target 14 may have a form 52.

Receiving coil 40 may be or include an NFC or RFID transducer, e.g., an inductor, used by target 14 to receive power from initiator 12 and to exchange data with initiator 12. For example, coil 40 may be a coiled conductor that converts field 60 to an electrical signal and vice versa. Field 60, directly or indirectly coupled to coils 24 and 40, supports contact-free communications between devices 12 and 14. The number of turns in coil 40, its dimensions, and other properties may be selected to support the applicable NFC or RFID standard. Coil 40 may be configured, oriented, tuned, sized, or otherwise adapted to be compatible with field 60. Coil 40 may be fabricated by various techniques including circuit printing techniques.

Coil 40 may function as a directional antenna. For example, a coil 40 proximate and parallel to the base of a game piece may be more sensitive in a direction substantially normal to the plane of the coiled conductor. In this example, the game piece may be more sensitive in a region near its base. Coil 40, like coil 70, may be a passive, resonant inductor. Accordingly coil 40, like coil 70, sometimes may be referred to as an inductive or resonant coil.

Communications system 42 may include any hardware or software suitable for implementing wireless data transfer according to a selected NFC or RFID standard. For example, target 14 may include one or more integrated circuits that generate, receive, and process power and/or data to/from initiator 12.

Memory 44 may include any data storage of target 14. For example, a target 14 implemented as NFC tag may store data in a persistent read-only memory and supply requested data when activated and interrogated by initiator 12.

Coil 40 may have associated electrical or electronic components 46, e.g., one or more capacitors and/or resistors, e.g., to tune the response of coil 40. Coil 40, connected in series or parallel to one or more resistors and/or capacitors, may implement an RLC circuit, for example.

Target 14 may include a power source 48, e.g., to operate one or more powered devices 50. Power source 48 may be any source of electrical power, e.g., a battery. Target 14 may omit power source 48, e.g., if power induced on coil 40 by coil 24 is sufficient to operate target 14. Adding a power source 48 may enable the inclusion of powered devices 50 that consume more power than the induced current can supply.

Target 14 may include one or more powered devices 50 that may implement any activity, feature, or behavior appropriate to target 14. A powered device 50 may include essentially any electrical, electro-mechanical, electronic, or computerized device. For example, a target 14 that takes the form of a game piece may include a light source that illuminates to indicate an event. Light 14L of FIG. 1A may be an example of a powered device 50.

Target 14 may have associated mechanical or decorative parts, collectively indicated as form 52. For example, a target 14 housed in a game piece may have parts that provide electrical insulation, mechanical support, and decorative configuration. Form 52 may provide thematic elements and exhibit any three-dimensional shape.

Field 60 may be an EM RF field used to transmit power and data between devices of system 10. Initiator 12 may initiate, maintain, and modulate field 60 according to a selected NFC or RFID protocol. Driving signal 62 may represent a signal applied by initiator 12 to coil 24, e.g., to provide energy to activate target 14. Initiator 12 may modulate signal 62, e.g., to interrogate target 14. Target 14 may receive and also modulate field 60, e.g. to return data to initiator 12, indicated by identifying signal 64.

Figure 1D:
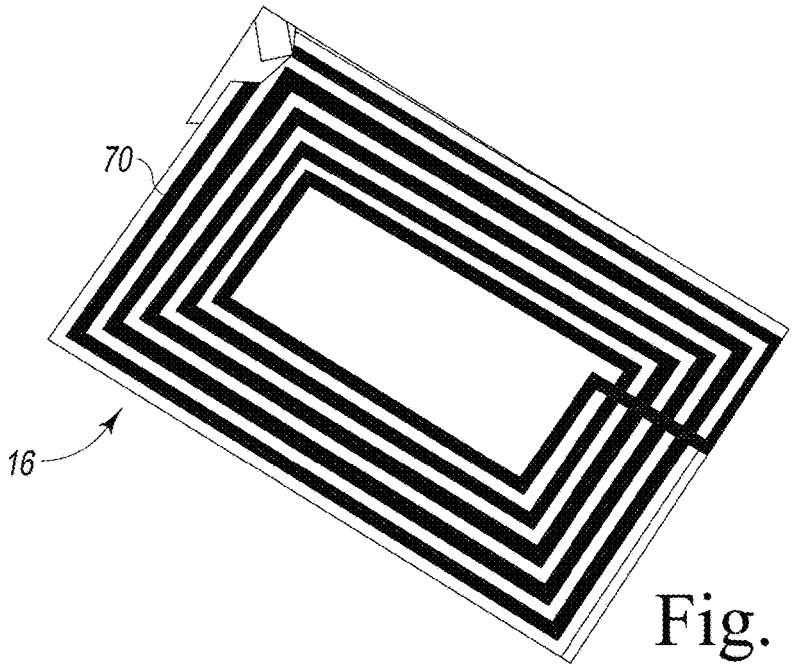
FIG. 1D shows a schematic of one embodiment of a resonant card (a playing card) that includes an inductive coil according to this disclosure.
Figure 5:
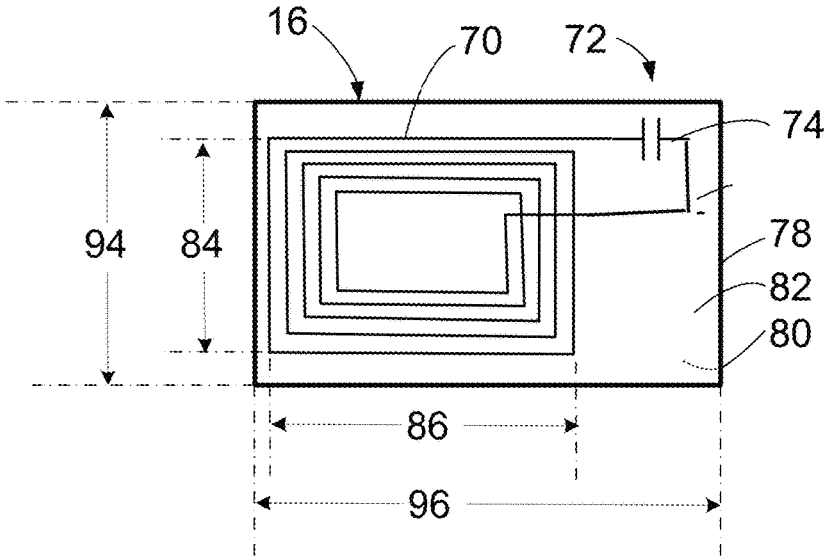
FIG. 5 shows a schematic top view of an example of a resonant card in accordance with the present disclosure.

With reference now also to FIGS. 1D and 5, system 10 may include one or more resonant cards 16. A card 16 may include a resonant coil 70 and further include electronic components 72, e.g., a capacitor 74. In some embodiments, not shown, the electronic components include both a tuned capacitor 74 and an added resistor. A tuned capacitor 74 may have a capacitance selected such that the coil 70 resonates with RF fields of a desired frequency. Card 16 may have an associated form 78 that may have a first face 80 (under, as drawn) and a second face 82 (upper, as drawn). Card 16 may include other, alternative, or additional elements and may omit one or more listed elements. A resonant card 16 may be referred to as a card 16 or a repeater card 16.

In a representative example, a card 16 may take the form of a game board that includes a coil 70 that extends the range of initiator 12, so that an activated target 14 may occupy a specified or more convenient position on the game board. In another example, a card 16 takes the form of a playing card, e.g., a substantially flat game piece that triggers a game feature when card 16 is activated by initiator 12. In yet another example, a system 10 may include multiple cards 16 that, when properly spaced, aligned, and overlapped, inductively couple primary coil 24 to receiving coil 40.

Resonant coil 70 may be or include a transducer, e.g., an inductor, e.g., a coiled conductor disposed within card 16. Coil 70, coupled to field 60, may function as a bridge between coils 24 and 40. Coil 70 accordingly may extend and/or modify communications distance, direction, and/or alignment between initiator 12 and target 14. For example, the presence of a card 16 may allow initiator 12 to activate target 14 at a greater distance and/or different angle than without card 16.

Coil 70 may be sized, oriented, tuned, or otherwise configured or adapted to be compatible with coils 24 and/or 40. For example, the length, width, capacitance, resistance, number of turns, and other properties may be selected so that coil 70 resonates at the selected NFC or RFID frequency of initiator 12. Coil 70 may be manufactured by various techniques including circuit printing techniques. Examples of a coil 70 include a coiled loop of wire made of copper or its alloys or a conductive trace printed in a spiral shape. A coil 70 may be referred to as a secondary coil or as a repeater coil.

Selecting the size of at least one dimension (width 84 or length 86) of coil 70 to approximately match an adjacent dimension (width or length) of primary coil 24, receiving coil 40, or an adjacent resonant coil 70' may increase the coupling of coil 70 with coil 24, 40 or 70'. For example, selecting width 84 to match an adjacent dimension of coil 24 may strengthen the coupling between coils 70 and 24, e.g., when aligned with the size-matched sides approximately adjacent and parallel. For example, it was found that at least one side of coil 70 preferably should be about the same size as coil 24, e.g., to generate a higher field strength to ring the passive resonant coil 70.

Coil 70 may act as a directional antenna and have a response generally only in a specified direction, e.g., perpendicular to the plane of coil 70. For example, a coil 70 within a flat card 16, parallel to its major faces 80, 82 may respond best when an adjacent coil overlaps one of faces 80 or 82. A face-to-face alignment of card 16 with initiator 12 and/or target 14, so that coil 70 and coils 24 and/or 40 are in substantially parallel planes, accordingly may induce a resonance between coils. A substantially parallel alignment of coils may therefore allow initiator 12 to activate target 14. It has been found that alignment variations are possible, with some angular tolerance in parallelism resulting in proper resonance between coils. The amount of tolerance may depend on various factors including the number of cascading resonant coils 70, the amount of overlap between adjacent coils, the amount of power needed to activate target 14, etc.

Figure 6:
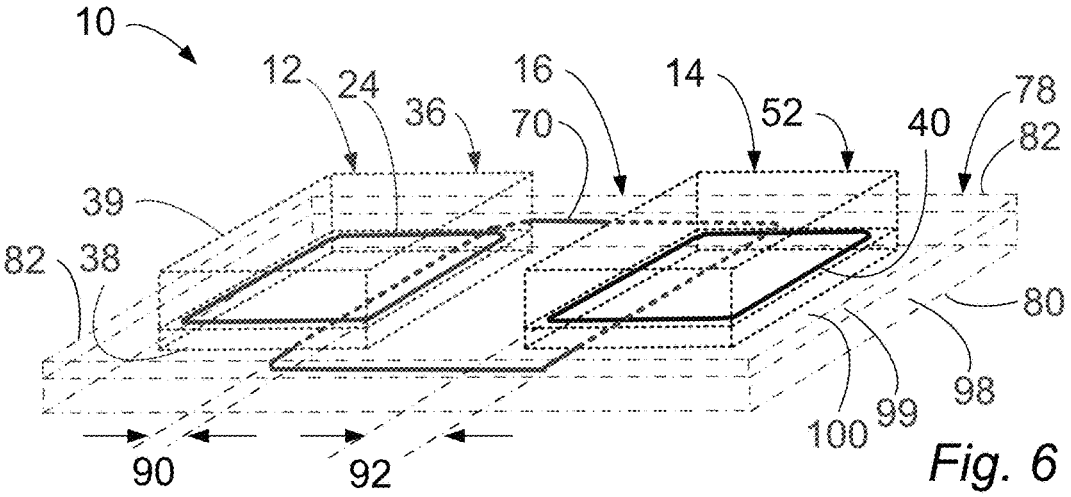
FIG. 6 shows a perspective view of an illustrative electronic game system that includes a resonant card configured as a game board.

Closer proximity between adjacent coils 24, 40, 70, and 70' may increase coupling between coils. For example, as shown in FIG. 6, face 82 of card 70 is substantially touching face 38 of initiator 12. For another example, placing two flat cards 16 together, with adjacent faces in direct contact, may maximize coupling between the included coils 70, separated only by the adjacent outer layers of the cards 16. Increasing vertical separation between coils (i.e., in a direction perpendicular to the coil plane) may increasingly reduce coupling.

Overlap between adjacent coils may increase coupling between coils. For example, as shown in FIG. 6, at least a portion of coil 24 may overlap with at least a portion of coil 70 at first overlap 90, and at least a portion of coil 70 may overlap with at least a portion of coil 40 at second overlap 92. Overlap between adjacent resonant coils 70 may similarly increase coupling. For example, it was found that arranging two similar resonant coils 70 to overlap by at least one-quarter of their coil length was sufficient to allow a first coil 70 to resonate a second coil 70'. In general, more-exact parallelism, a closer proximity, and a greater overlap between pairs of coils may increase the operative coupling between coils. For clarity, FIG. 6 depicts coils 24, 40, 70 in solid lines and other structure in dashed or dash-dot lines.

The directionality and efficiency of coils 24, 40, 70 may be specifiable properties and serve as features of a game. For example, a system 10 may include multiple cards 16. Each card 16 may include a resonant coil 70, and various resonant coils 70 may be differently configured to increase or reduce efficiency. The rules of the game may include selecting a card 16 and placing the card 16 in a predetermined position where an efficient card 16 may activate target 14 and an inefficient card 16 may fail to activate target 14. Successful or unsuccessful activation, governed by selection of a card 16, may be a feature of game play. A game similarly may involve events or activities that change the location or orientation of one or more coils 24, 40, or 70, thereby enabling or disabling activation of target 14, e.g., as a feature of game play.

Card 16 may have associated electronic or electronic components 72, e.g., a one or more capacitors 74, which may be connected to coil 70. This configuration may implement an LC circuit that can be tuned to resonate with coil 24 and/or coil 40. For example, FIG. 5 shows a card 16 that includes a coil 70 and capacitor 74. Examples of capacitors 74 include tunable, surface-mount RF capacitors.

In a sample embodiment of a card 16, a coil 70 was fabricated as a 6×5 spiral made of cut copper (or copper alloy) sheet, starting at 1.5 inch in the center and spiraling out to the perimeter of card 16, simulating fabrication as a printed circuit board. In another embodiment constructed of looped wire, resonant coil 70 was fabricated as four turns of enamel-insulated wire at 3.12 μH with parallel forty-four picofarads capacitance. Another sample used six turns of wire at 6.1 μH with parallel twenty-two picofarads capacitance. Yet another sample used four turns of wire at 4.15 μH with parallel thirty-three picofarads capacitance.

Tolerance to get a single coil to repeat (that is, to couple coil 24 to coil 40 via one coil 70 so that initiator 12 activated target 14) was found to be +/−fifteen percent of the value of capacitor 74. Tolerance to get four overlapping coils (that is, four overlapping cards 16) was found to be +/−three percent of the value of capacitor 74. Tolerance for wire used for winding was found to be non-critical in that wire tolerances can be precisely controlled. A tuning method was found to be to excite the coil with a tunable capacitor connected in parallel with the coil, starting with a calculated initial value and adjusting for resonance and/or field intensity.

As more and more coils load the exciter, it was found appropriate to readjust the entire coil configuration to a tighter capacitor tolerance. For example, in a system 10 with multiple, overlapping cards 16, it was found appropriate to select the tolerance of each capacitor 74 according to the anticipated maximum number of overlapping cards 16.

Card 16 may have associated functional or decorative elements, collectively form 78. For example, a card 16 configured as a game board may include a coil 70 sandwiched between a first outer layer 98 and a second outer layer 99. A layer 98, 99 may provide a playing surface 100, e.g., a substantially flat area for game play, e.g., for activities such as placing game pieces on surface 100, moving pieces between regions of surface 100, etc. Form 78 may provide electrical insulation and physical support for coil 70 and as well as a convenient surface for printed or applied decorations. Form 78 may exhibit any three-dimensional shape and provide thematic elements. The word "card" does not limit card 16 to a planar shape.

Figure 7:
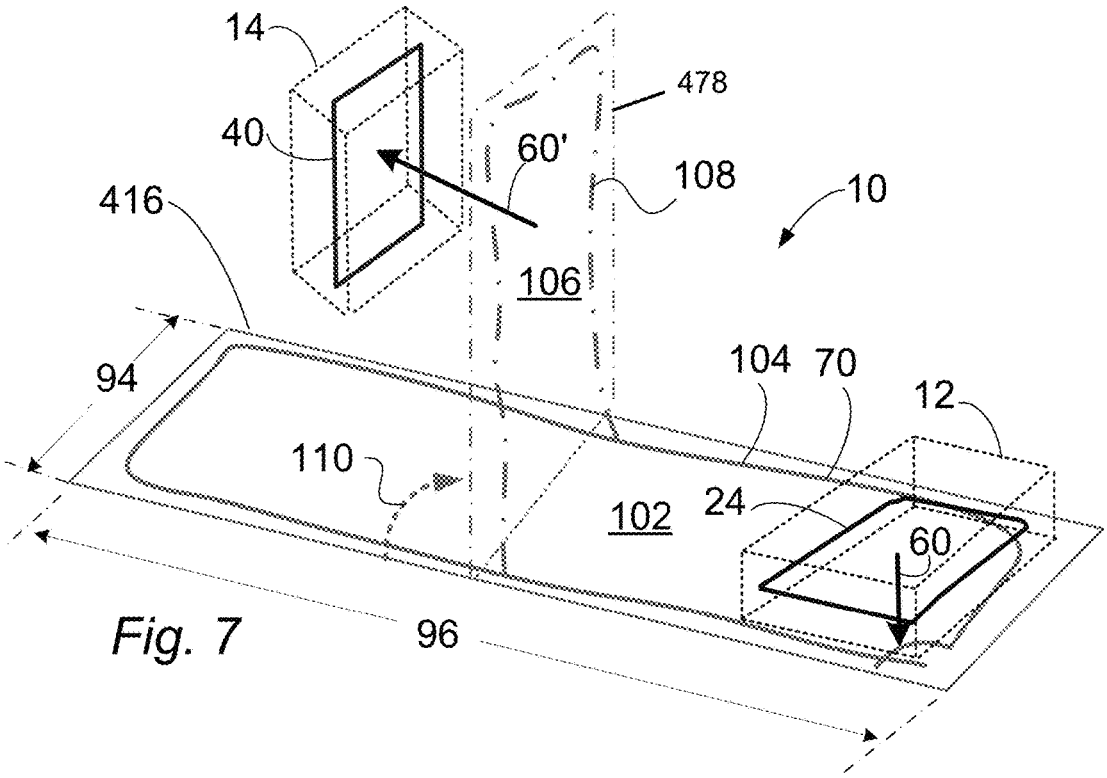
FIG. 7 shows an illustrative example of a resonant card folded at an angle.

A card may have an elongate form 78. As shown in FIG. 7, for example, card length 96 may significantly exceed card width 94, creating an elongate form 78.

In an embodiment, initiator 12 may transmit power to target 14 via one or more cards 16 without processing data from target 14. Initiator 12 may energize target 14 via driving signal 62 and either not interrogate target 14 or disregard any data returned. A system 10 that uses a mobile phone as an initiator 12, for example, may simply use the phone as a convenient, remote power source for target 14.

Referring also to FIG. 7, in an embodiment, a card 416 may have a folded or foldable form 478 (shown in dashed lines), e.g., to redirect field 60 to a different location or direction than field 60 would have without folding. A folded card 416 may permit an initiator 12 to energize a target 14 in a different position and/or orientation than otherwise. A folded card 416 accordingly may relocate the region within which target 14 becomes activated. For example, as shown in FIG. 7, a card 416 may have a first configuration substantially in one plane—that is, unfolded and approximately flat, as shown in solid lines. A portion of the card 416 may be foldable to a second position, shown in dash-dot lines. A first card portion 102 may remain in place and define a first coil plane that includes a first coil portion 104. A second card portion 106 may pivot from its original, unfolded position to a second, folded position that defines a second coil plane and includes a second coil portion 108. After folding, card 416 exhibits a second, folded configuration.

Fold angle 110, the angular offset between card portions 102 and 106 when folded, may be any appropriate or predefined angle up to contact between card portions or devices. Angle 110 may be variable, e.g., as a feature of game play.

Field 60 of first card portion 102 may have a different orientation than field 60' of second card portion 106 in its folded second position. For example, an initiator 12 placed on first card portion 102 may induce field 60 in first coil plane. Coil 70 continues within card 416 to second portion 106 in second coil plane. The second plane, angled with respect to the first plane, in effect emits/receives field 60' redirected by fold angle 110. The orientation and location of field 60' of second portion 106 in its folded position thus may differ from the orientation and location of field 60' of second portion 106 in its unfolded position. Target 14 with coil 40 coupled to second coil portion 108 accordingly may activate in a different location or orientation than it would in unfolded position. Folding a card 416 may allow a game designer to relocate or reorient the region of space within which initiator 12 energizes target 14. For example, the designer may fold a coil 70 around a corner, e.g., to create a feature of game play.

A card 416 may be permanently folded—i.e., a fold may be a fixed feature of form 478. Additionally or alternatively, a card 416 may be flexible, so that it may be folded and unfolded, e.g., as an activity performed by a player. Rules may direct a player to fold card 416 at a various angles 110, for example, only one of which activates target 14.

Figure 8:
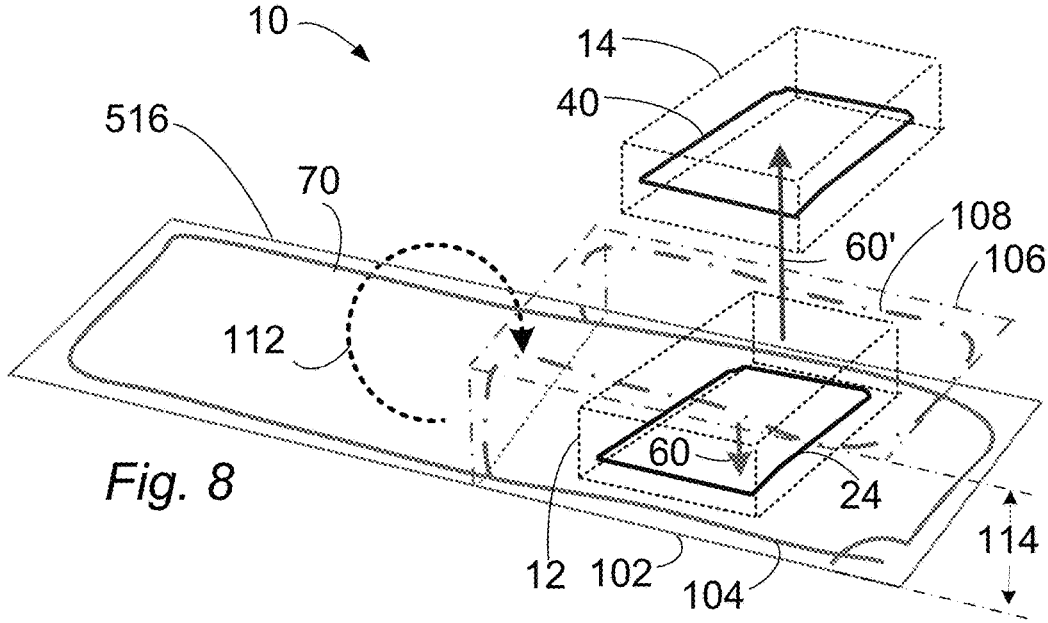
FIG. 8 shows a representative example of a resonant card wrapped around an initiator device.

A different folded card 516 of FIG. 8 may be identified as a C-Fold card, because a side view of folded card 416 generally describes a C-shape. This C-shape allows initiator 12 to be located on the bottom of a mobile phone, communicating directly with first card portion 102 while the second card portion 106 is located on the top of the phone. Initiator 12 may therefore be located in a first coil plane, while active gameplay occurs in a second coil plane substantially above the first coil plane.

Referring now to FIG. 8, a card 516 may have a wrapped or wrappable form 78. A wrapped card 516 may be considered generally similar to a folded card 416. For example, wrapping may be accomplished by folding a card 516 more than once, e.g., to achieve a large fold angle (cumulatively wrap 112) and/or leave a spacing distance 114 between card portions. Wrapping alternatively may be accomplished by a sweeping, gradual fold in a card 516, e.g., to allow the card 516 to wholly or partly surround an initiator 12, target 14, or another resonant card.

A wrapped card 516, like a folded card 416, may redirect field 60 to a different location and/or direction than field 60 would have without wrapping. A wrapped card 516 thus may permit initiator 12 to energize a target 14 in a different position or orientation than otherwise. The transition from first, unwrapped position (solid lines) to second, wrapped position (dash-dot lines) may be comparable to the folding transition described above and understood by analogy. The functional result of a wrapped coil 70 may also be understood by analogy to that of a folded coil 70.

For example, FIG. 8 shows wrapped card 516 that partly surrounds initiator 12 with coil 24 situated on its bottom surface, e.g., first face 38 of a mobile phone. Wrapping 112 in effect redirects field 60 (induced by initiator 12 on first card portion 102) as field 60' (received by target 14 from second coil portion 108). The region that activates target 14 after wrapping card 516 differs from that without wrapping card 516.

A card 516 may be permanently wrapped—i.e., a wrapped shape may be a fixed feature of form 78. Additionally or alternatively, a card 516 may be flexible, so that it may be wrapped and unwrapped. With a flexible card 516, wrapping may be an activity performed by a player of a game.

Figure 9:
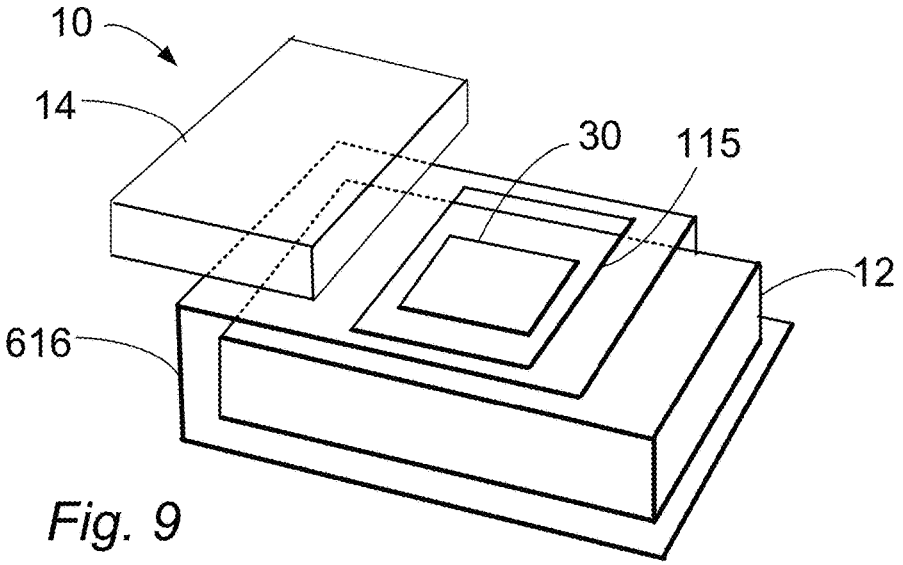
FIG. 9 shows an illustrative example of a resonant card that includes a transparent portion wrapped around an initiator device that includes a display, and configured so that the display is visible through the transparent portion.

Referring also to FIG. 9, a card 616 may have a transparent portion or window 115 situated to allow all or part of initiator 12, target 14, or another resonant card to remain visible through card 616. For example, a mobile phone that includes an initiator 12 may include a display device 30, e.g., a display panel. Window 115, aligned with display 30, may allow display 30 to remain visible, e.g., through windowed card 616. For example, software 34 that implements a game running on initiator 12 (e.g., the phone) may use display 30 to indicate events during game play by changing displayed graphics, which remain visible through window 115.

Figure 10:
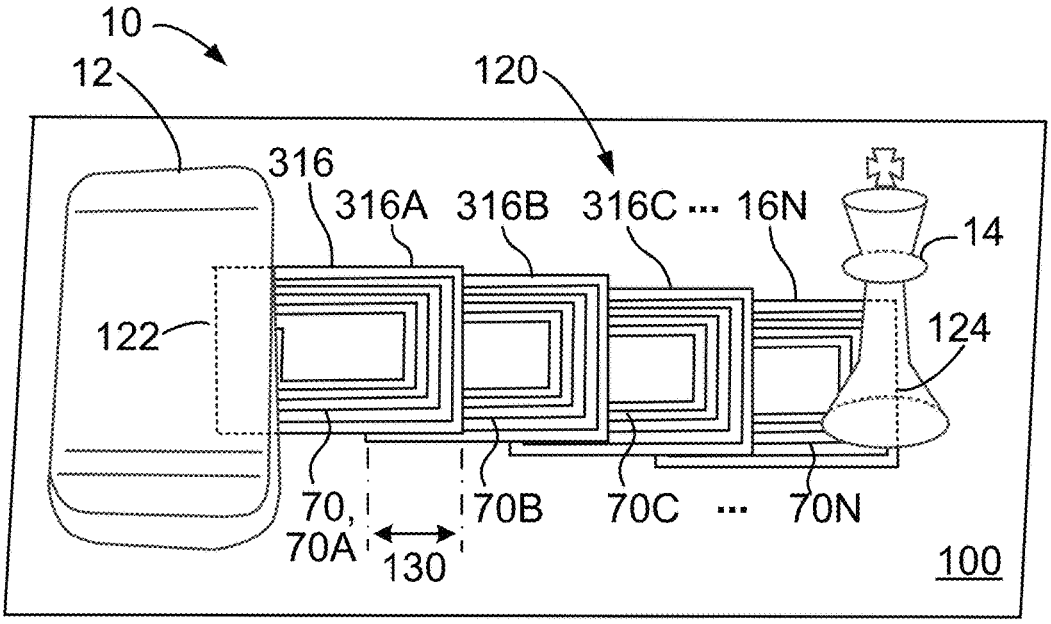
FIG. 10 shows a perspective view of an illustrative electronic game system that includes a plurality of resonant cards configured as game pieces and successively overlapped in a shingled configuration.

FIG. 10 shows an embodiment of system 10 that (like that of FIGS. 2A and 2B) includes a plurality of cards 316. Two or more cards 316 may be configured and arranged to resonate together and to function as an inductive bridge from initiator 12 to target 14. Taking a system 10 with two cards 316 as an example, initiator 12 may couple to a first card 316A; the first card may couple to a second card 316B; and the second card 316B may couple to target 14. This series or cascade of mutually coupled cards 316 thus may allow initiator 12 to activate target 14 at a different location and/or orientation than otherwise obtained, e.g., over a greater distance between initiator 12 and target 14.

In the example of FIG. 10, system 10 includes an array 120 of cards 316A-N, where the A-N notation indicates an indefinite number of cards 316. Card 316A, the first card of array 120, is proximate to and inductively coupled with initiator 12. Card 316B, the second card of array 120, overlaps with card 316A and is coupled to first card 316A. As shown by overlap 130 between cards 316A and 316B, at least a portion of coil 70A of card 316A overlaps with at least a portion of coil 70B of card 316B, so that coil 70A couples with coil 70B. Subsequent cards continue in this overlapping, shingled arrangement up to card 316N, the last card of array 120, which is proximate to and coupled with target 14. Array 120 has a first end 122 toward initiator 12 and a second end 124 toward target 14. Initiator 12 at first end 122 may, via the multiple cards 316A-N, energize and activate target 14 at second end 124.

Adjacent cards 316A-N in array 120 may be arranged in close proximity, e.g., and achieve a strong coupling between adjacent coils 70A-N. Planar cards 316, for example, may be arranged so that their adjacent major faces touch each other, in face-to-face contact, to bring the respective coils 70A-N as close together as possible. Additionally or alternatively, coils 70A-N of adjacent cards may be arranged in approximately parallel planes, e.g., to achieve a strong coupling between adjacent coils 70A-N. Additionally or alternatively, coils 70A-N may be arranged to overlap, e.g., as shown by overlap 130 between cards 316A and 316B.

The maximum number of cards 316A-N in an array 120 that can transfer enough power from initiator 12 to target 14 to activate target 14 may depend on these and other factors, alone or in combination. It was found that an overlap 130 between adjacent coils 70 of about one-quarter the length of a coil 70 was sufficient to adequately couple the adjacent coils. A system 10 with four overlapped cards 316 was found to have enough forgiveness in orientation that a card 316 did not have to be completely in the same plane as an adjacent, overlapping card 316. Coils 70 ideally should lay completely flat for maximum field intensity from one coil to the next. In a system 10 with coils 70 with high Q, it was found that a small amount of energy from initiator 12 rang the resonant coils 70 at a very high rate, which allowed chained series of six resonant coils 70.

An example of a system 10 with multiple cards 316 is a game that uses multiple cards 316 to cover a predetermined distance from initiator 12 to target 14. For example, the rules of a game may include an activity or event that rewards a player by allowing the player to add a new card 316 to the next open position of array 120, which penalizes the player by removing an already-added card 316, etc. The goal of the game may be to accumulate an array 120 of coupled cards 316 that cover a predetermined distance from a starting point (initiator 12) to an ending point (target 14). Target 14, when activated by initiator 12, may for example light up to announce a winner. Many different games that take advantage of the principles of this disclosure are possible.

Figure 11:
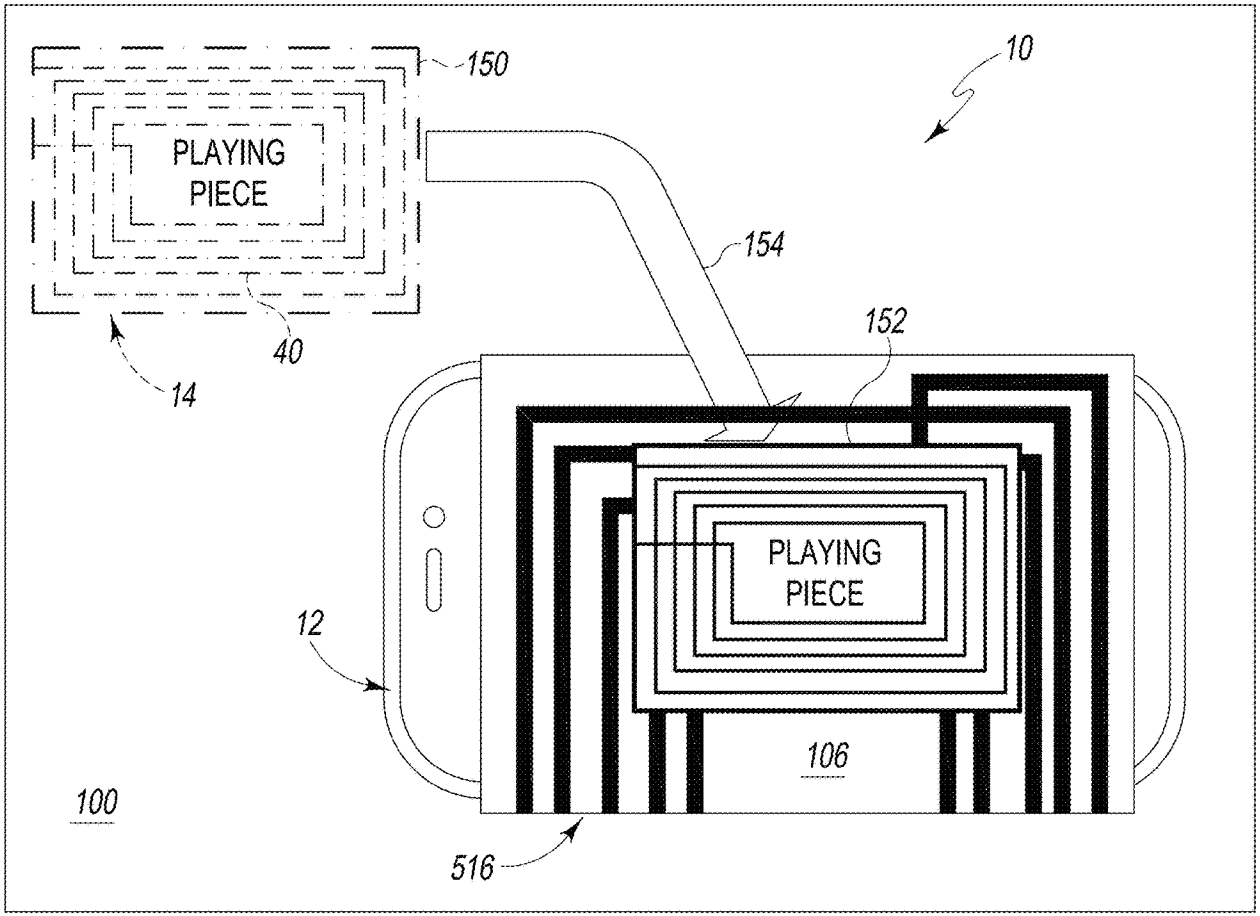
FIG. 11 shows an illustrative example of a method of game play in an electronic game system that includes an initiator device, a C-Fold resonant card wrapped around the initiator, and a target device configured as a playing piece, wherein the player moves the playing piece from a first (inactivated—shown in dashed lines) target position to a second (activated—shown in solid lines) target position.
Figure 12:
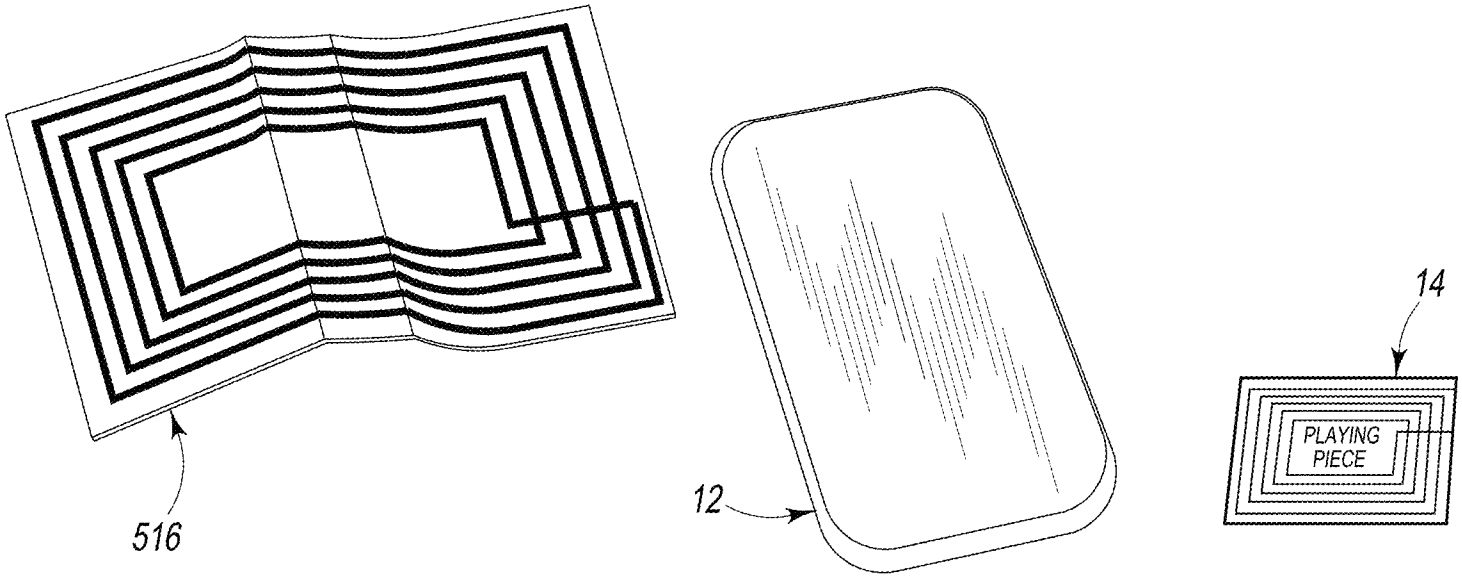
FIGS. 12-15 show the C-Fold card and other elements of the electronic card game system of FIG. 11, in various relative placements.
Figure 13:
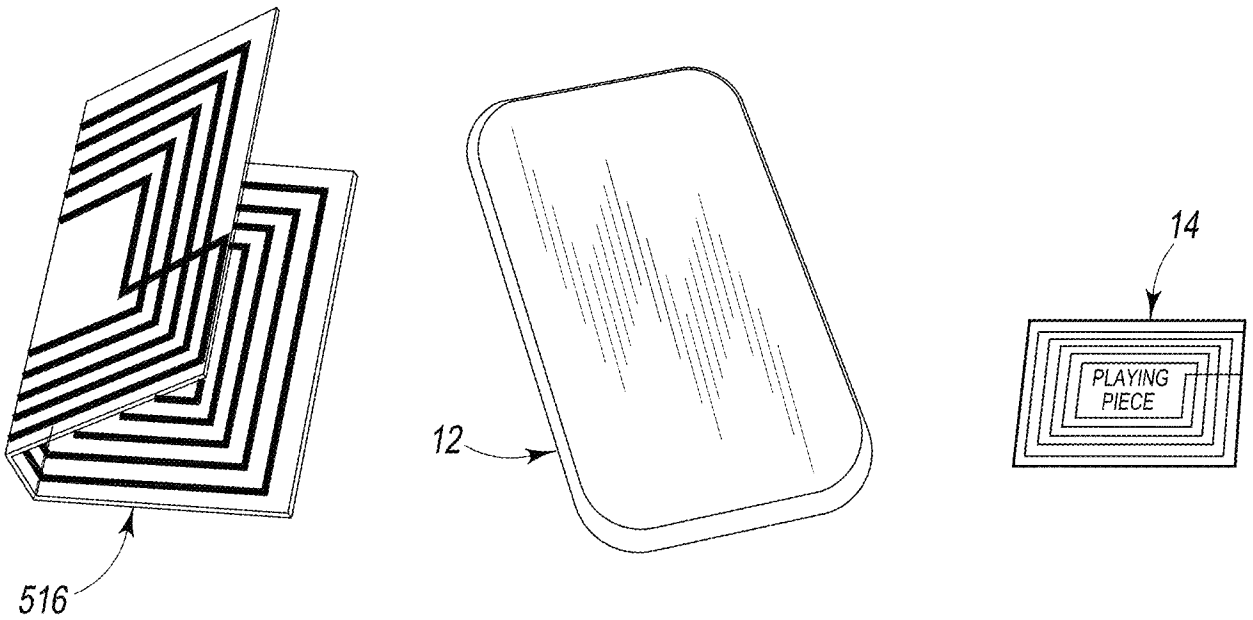
Figure 15:
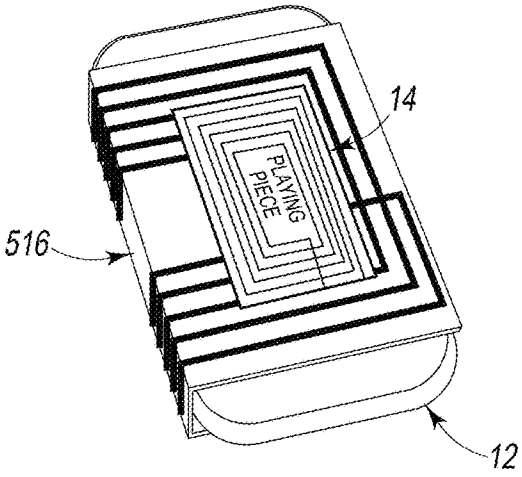
Figure 14:
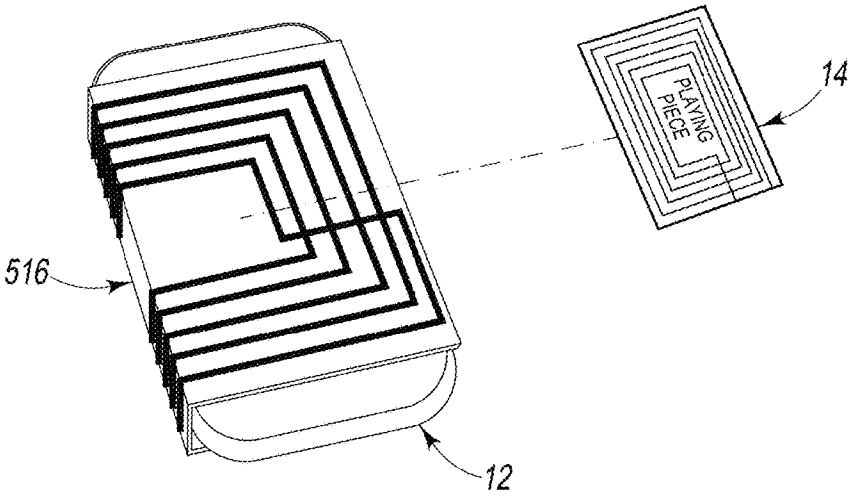

With reference now also to FIG. 11, a method of play for a system 10 may include activities that include a player moving a target 14 from a first, inactive position to a second, activated position. For example, as shown in FIG. 11, a system 10 may include an initiator 12, a flexible card 516 (or 616) that can be wrapped around initiator 12, and a target 14 taking the form of a playing piece 14. The game may start when a player wraps card 516 around initiator 12. As the game progresses, the player may locate piece 14 at a specified first position 150 on playing surface 100, where position 150 is sufficiently distant from initiator 12 to avoid activating piece 14. As the game continues, the player may move 154 piece 14 to a second position 152 on top of wrapped card 516 and above initiator 12. Second position 152 places piece 14 in direct, parallel, face-to-face contact with the wrapped, second portion 106 of card 516. The wrapped second portion 108 of resonant coil 70, in close proximity to coil 40 of target 14, allows the coils 24, 40, 70 to resonate, thereby activating target game piece 14. Initiator 12 may interrogate the activated game piece 14 for an identifying signal 64, e.g. to control the game according to one or more values read from activated game piece 14.

Different steps in the method of play for a system 10 are shown in FIGS. 12-15, more clearly showing use of a C-Fold resonant card.

Figure 16:
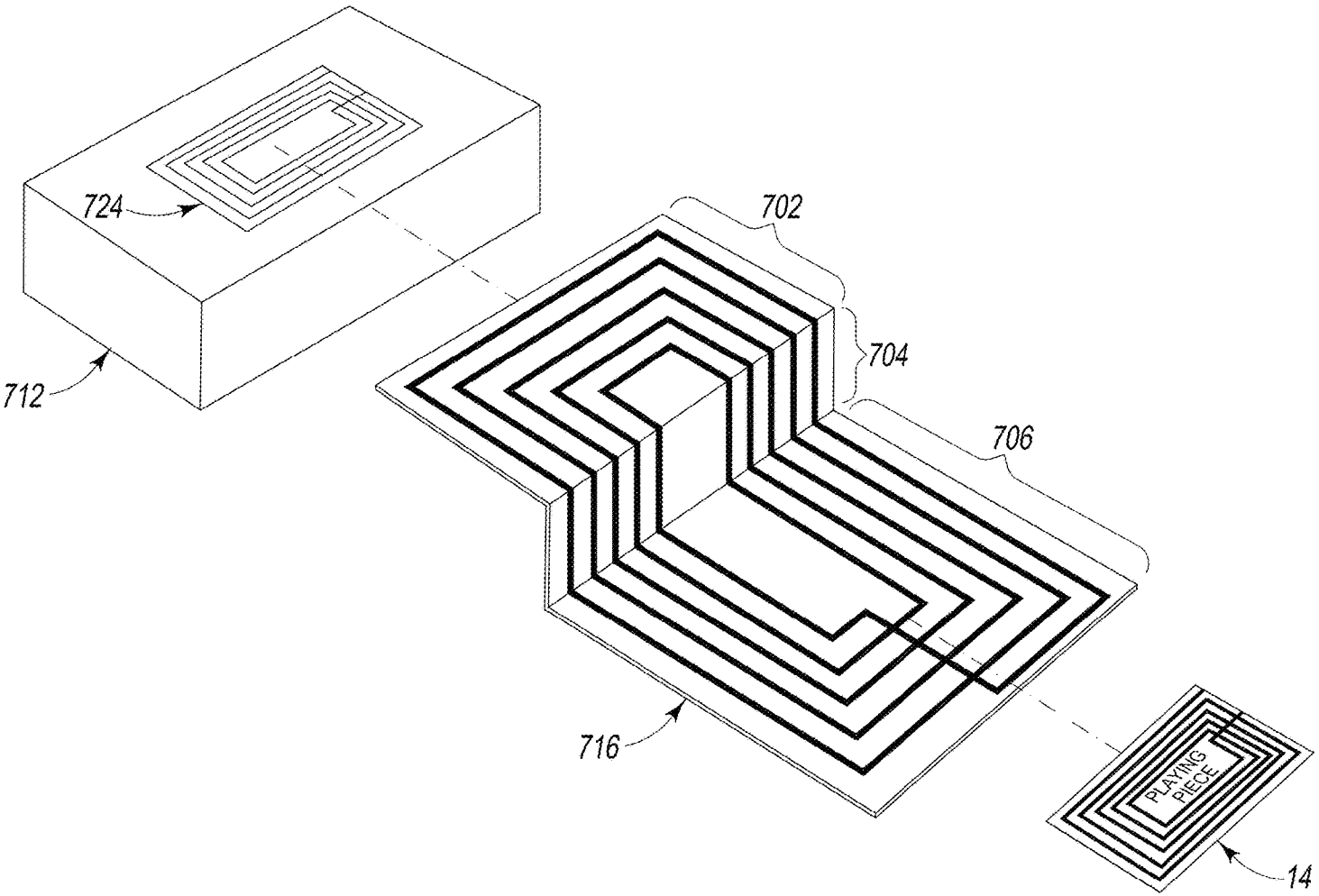
FIGS. 16 and 17 show a Z-Fold card and other elements of the electronic card game system, in various relative placements.
Figure 17:
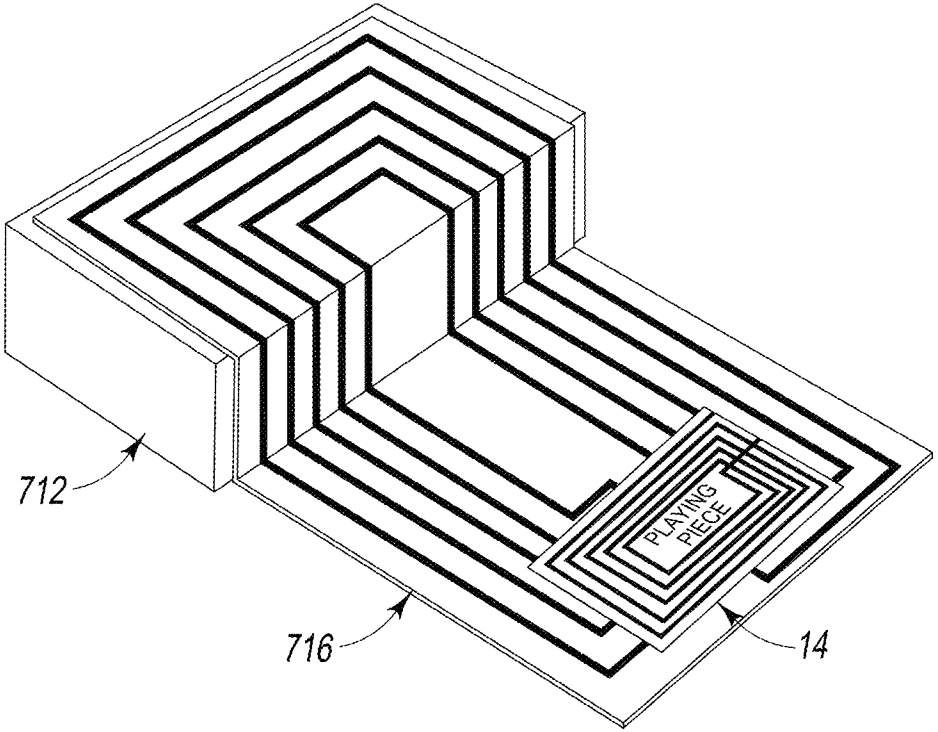

FIG. 16 shows an alternative embodiment of a folded card, in the form of a Z-Fold resonant card. This alternative folding of folded card 716 may define a Z-shape, which allows primary coil 724 of initiator 712 to be located on the top of an initiator, communicating directly with first card portion 702 while the second card portion 706 is located on a table or other supporting surface for the mobile phone and folded card 716. Initiator 712 may include a driving coil 716*c*, located in a first coil plane, while active gameplay occurs in a second coil plane substantially below the first coil plane. Second coil plane is defined generally by the thickness of folded card 716, relative to an underlying playing surface that supports folded card 716. Active use of such an electronic card game system is shown in FIG. 17.

The relative proportions of a folded card may be varied, to define a larger or smaller first card portion, and separately define a larger or smaller second card portion. For example, a folded card 716 as shown in FIGS. 16 and 17 may be identified as a Z-Fold card, because a side view of folded card 716 generally describes a Z-shape. As shown, first card portion 702 is relatively smaller than second card portion 706. The first card portion 702 defines a top flap of the Z-Fold repeater coil card that rests on top of initiator 712, such as an RFID/NFC base unit. The middle portion 704 of the Z-Fold card runs down a side of the initiator 712. The second card portion 706 defines a bottom flap of the Z-Fold card that extends a driver signal from the initiator 712 to a portion of the tabletop surface.

This Z-Fold configuration and relative proportions may be particularly useful with a relatively small, self-contained initiator 712. Self-contained initiator 712 may be sold as an accessory or packaged component of a game set, as desired. Furthermore, gameplay may include both a mobile phone as one initiator, and a self-contained initiator 712 as a second initiator, allowing creation of a first playing field with multiple overlapping cards 16, and a separate second playing field with multiple overlapping cards 16. The self-contained initiator 712 may be substantially smaller than a mobile phone.

Figure 18:
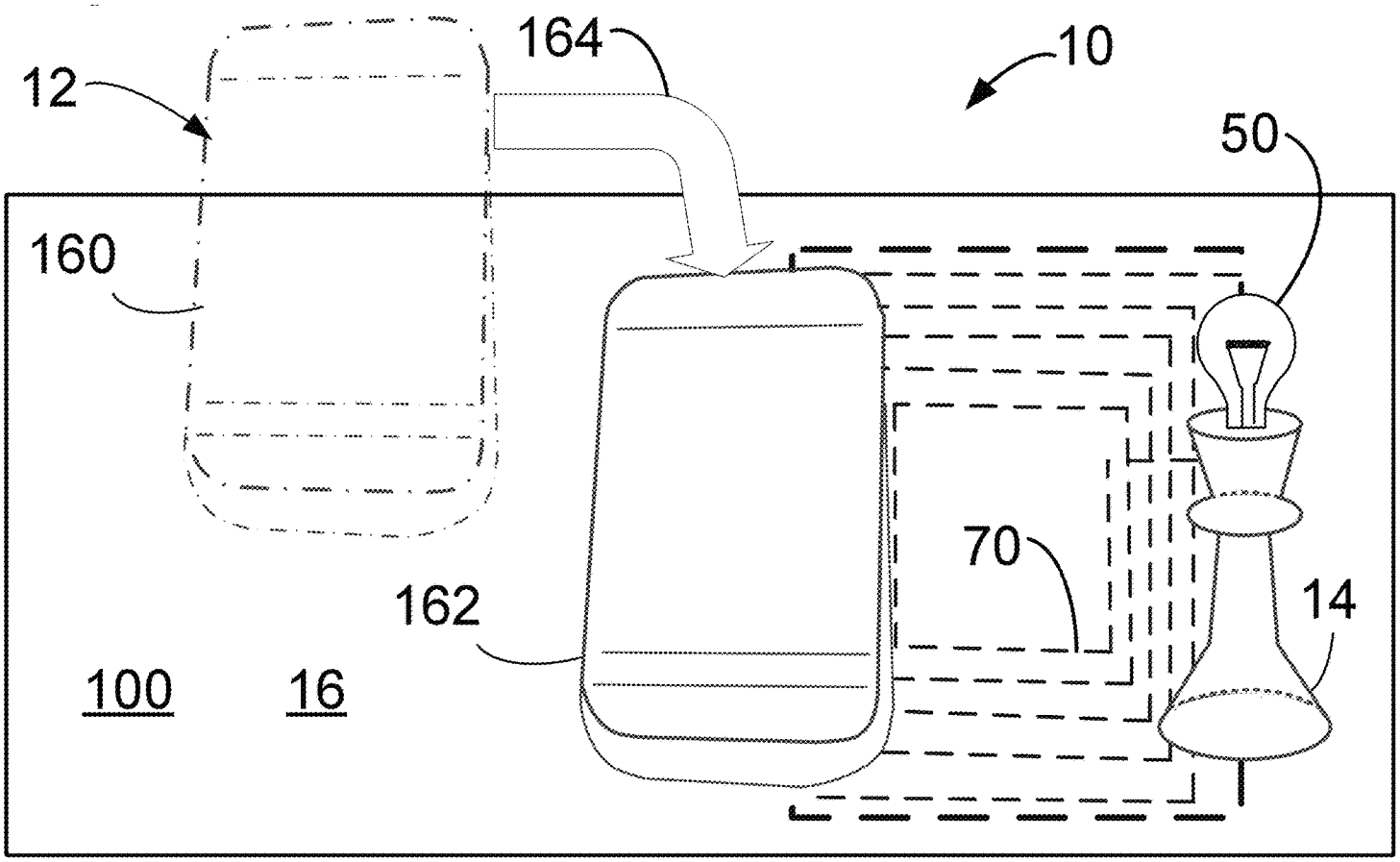
FIG. 18 shows an illustrative example of a method of game play in a game system that includes a resonant card configured as a game board, wherein the player moves the initiator device from a first (inactivated) position on the game board to a second (activated) position on the game board, thereby activating a target device configured as a playing piece.

With reference now also to FIG. 18, a method of play for a system 10 may include activities that include a player moving an initiator 12 from a first, inactive position to a second, activated position.

A system 10 may include a movable initiator 12, a card 16 configured as a game board 16 with a playing surface 100 and including a resonant coil 70 in occupying a selected portion of board 16; and a target 14 that includes a powered device 50, e.g., a light source. The game may start with the player placing initiator 12 in a first position 160, e.g., a designated portion of board 16 sufficiently distant from coil 70 to avoid activating target 14. Under the rules of the game, a player may at 164 move initiator 12 to a second, activated position 162. In position 162, at least a portion of coil 24 overlaps with at least a portion of coil 70, which in turn overlaps with at least a portion of coil 40. This arrangement allows initiator 12 to activate the target 14, which may respond by illuminating powered device 50, such as a light.

The following paragraphs may provide further information regarding example embodiments.

Figure 19:
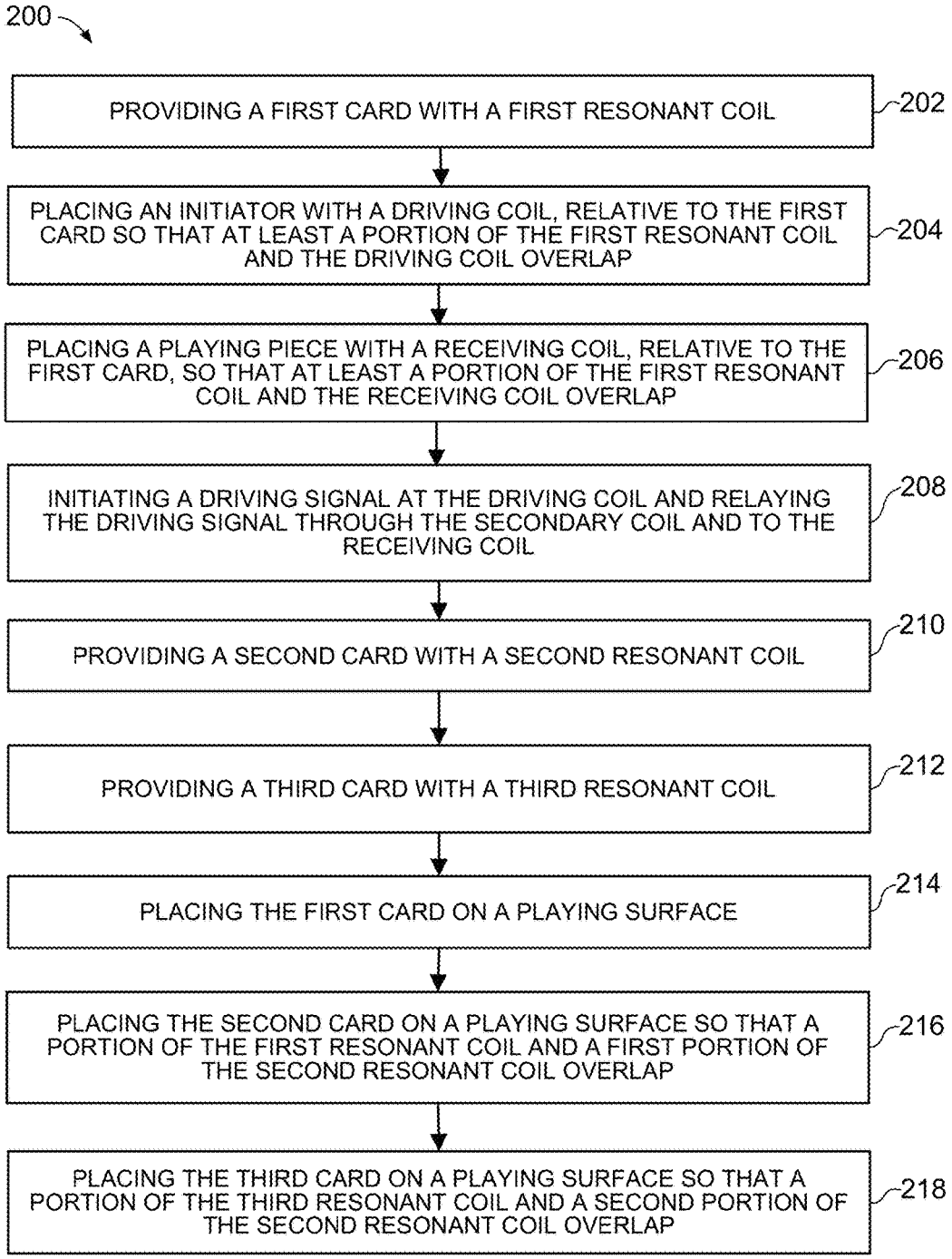
FIG. 19 shows an exemplary method of game play according to this disclosure.

With reference now also to FIG. 19, a method 200 for playing an electronic card game system 10 may include providing 202 a first card 16 with a first resonant coil 70; placing 204 an initiator 12 with a driving coil 24, relative to the first card 16 so that at least a portion of the first resonant coil 70 and the driving coil 24 overlap; placing 206 a playing piece 14 with a receiving coil 40, relative to the first card 16, so that at least a portion of the first resonant coil 70 and the receiving coil 40 overlap; initiating 208 a driving signal 62 at the driving coil 24 and relaying the driving signal 62 through the secondary coil 70 and to the receiving coil 40; providing 210 a second card 16 with a second resonant coil 70; providing 212 a third card 16 with a third resonant coil 70; placing 214 the first card 16 on a playing surface 100; placing 216 the second card on the playing surface 100 so that a portion of the first resonant coil 70 and a first portion of the second resonant coil 70 overlap; placing 218 the third card 16 on the playing surface 100 so that a portion of the third resonant coil 70 and a second portion of the second resonant coil 70 overlap.

An electronic card game system 10 may include an initiator 12 having a driving coil 24; a first card 16 having a secondary coil 70 with a capacitor 74; a playing piece 14 having a receiving coil 40; wherein at least a portion of the driving coil and at least a portion of the secondary coil overlap; and wherein at least a portion of the receiving coil and at least a second portion of the secondary coil overlap; and wherein a driving signal 62 initiated at the driving coil may be transmitted through the secondary coil and received by the receiving coil.

The electronic card game system 10 of the previous paragraph may further include a second card 16 having a secondary coil 70 with a capacitor 74; wherein at least a first portion of the secondary coil of the second card and at least the second portion of the secondary coil of the first card overlap; and wherein at least a portion of the receiving coil 40 and at least a second portion of the secondary coil of the second card 16 overlap; and wherein a driving signal 62 initiated at the driving coil may be transmitted through the secondary coils of the first card and the second card and received by the receiving coil.

The electronic card game system 10 as disclosed may further include a second card 16 having a secondary coil 70 with a capacitor 74; wherein at least a first portion of the secondary coil of the second card and at least the second portion of the secondary coil of the first card overlap; and wherein at least a portion of the receiving coil and at least a second portion of the secondary coil of the second card overlap; and a third card having a secondary coil with a capacitor; wherein at least a first portion of the secondary coil of the third card and at least the second portion of the secondary coil of the second card overlap; and wherein at least a portion of the receiving coil and at least a second portion of the secondary coil of the third card overlap; and wherein a driving signal initiated at the driving coil may be transmitted through the secondary coils of the first card and the second card and the third card and received by the receiving coil.

The electronic card game system 10 as disclosed wherein the driving coil 24 transmits a resonant field 60 primarily on a first side of the initiator 12; and the first card folds from the first side of the initiator to a second side of the initiator.

The electronic card game system 10 as disclosed wherein the driving coil 24 transmits a resonant field 60 primarily on a first side of the initiator 12; the initiator includes a display screen 30 on a second side of the initiator; the first card folds from the first side of the initiator to a second side of the initiator so that the first card at least partially overlaps the display screen; and the first card is at least partially transparent or cut away so that the display screen may be viewed through the first card as the playing piece is removed from overlapping the second portion of the secondary coil.

An electronic card game system 10 including a playing or resonant card 16 having a secondary or resonant coil 70 disposed within the playing card 16 in a two-dimensional plane; a initiator 12 or two-way radio 12 having a primary coil 24 that may fold around the two-way radio in a three-dimensional aspect; and a target 14 or transponder 14, which emits an identifying signal 64 that is sent back to the two-way radio via the card; wherein placing the two-way radio in any position where the primary coil comes within range of the secondary coil within the playing card will relay a radio frequency field 60 from the primary coil through the playing card; wherein placing the transponder within range of the secondary coil within the playing card will respond with an identifying signal 64 that will relay back to the two-way radio.

An electronic card game system 10, including an initiator 12 or two-way radio 12; a primary coil 24 that receives its power from the two-way radio and generates a radio frequency field 60; wherein the primary coil 24 may be folded around the two-way radio such that the two-way radio may make proper connection with the secondary coil 70 within the playing card 16 on one or more surfaces of the two-way radio; a playing card 16 having a secondary coil 70 that allows the radio-frequency field to be relayed from the primary coil; and a target or transponder 14 that receives its power from the radio-frequency field and responds with an identifying signal 64; wherein one or more playing cards may be placed sufficiently overlapping one another in an array 120; wherein placing the two-way radio on the first end 122 of the array 120 will relay the radio frequency to the second end 124 of the array 120; wherein placing the transponder on the second end of the array with the two-way radio placed on the first end the array will induce the transponder to emit an identifying signal 64 that will relay back to the first end of the array where the two-way radio may receive it.

An electronic card game system 10, comprising a radio-frequency field 60 generated by an initiator 12; an electromagnetic relay that relays the radio frequency field comprised of one or more playing cards; a playing piece that senses the radio frequency field and responds with an identifying signal; and a reader that receives the identifying signal; wherein the one or more playing cards may be positioned such that a first playing card is overlapped by a second and the second playing card is overlapped by a third and so forth to a last playing card; wherein placing the initiator on the first playing card and the radio frequency generated will relay across the one or more cards; wherein placing the playing piece on the last playing card will receive the radio frequency and initiate the playing piece to respond with the identifying signal; wherein placing the reader within range of the electromagnetic relay will receive the identifying signal;

An electronic card game system, including an initiator having a primary coil, wherein a radio-frequency field may be generated and received; a playing card having a secondary coil, wherein the radio frequency field may be transmitted; a playing piece having a receiving coil, wherein the radio frequency field may be received and may respond with an identifying signal; and wherein placing the initiator and the playing piece on opposite ends of the playing card and within range to make an electromagnetic connection with the playing card will cause the radio frequency field generated by the initiator to transmit through the playing card to the playing piece; wherein the playing piece uses the radio frequency field to power up and respond with the identifying signal, which is transmitted through the playing card and received by the initiator.

A method for playing an electronic card game, including providing a two-way radio having a primary coil; activating the two-way radio; wherein the two-way radio having a power source that generates a radio frequency field through the primary coil; providing one or more playing cards, each having a secondary coil; arranging the one or more playing cards in operative contact with each other; wherein an electromagnetic relay is created by the operative contact of the one or more secondary coils, and through which the radio frequency field can be transmitted; placing the two-way radio in operative contact with one or more playing cards; wherein the radio frequency field generated by the activated two-way radio transmits through the one or more playing cards; and providing a playing piece having a receiving coil; placing the playing piece in operative contact with one or more playing cards; wherein the radio frequency field transmitted through the one or more playing cards is received by the receiving coil, which powers the playing piece to respond with an identifying signal transmitted through the one or more playing cards and received by the two-way radio.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. An electronic card game system for use with an initiator having a driving coil, comprising:

a first card having a secondary coil with a capacitor;

a playing piece having a receiving coil;

wherein the initiator and the first card may be placed on a playing surface so that at least a portion of the driving coil and at least a portion of the secondary coil overlap;

wherein the first card and the playing piece may be placed on the playing surface so that at least a portion of the receiving coil and at least a second portion of the secondary coil overlap;

wherein a driving signal initiated at the driving coil may be transmitted through the secondary coil and received by the receiving coil; and wherein:

the first card is a Z-fold repeater coil card including a top portion that is relatively smaller than a bottom portion;

the top portion defines a top flap of a Z-Fold that rests on top of the initiator;

a middle portion of the Z-Fold card runs down a side of the initiator; and the top portion, the middle portion, and the bottom portion collectively extend a driving signal from the initiator to the playing surface.

2. The electronic card game system according to claim 1, further comprising:

a second card having a secondary coil with a capacitor;

wherein the first card and the second card may be placed on the playing surface so that at least a first portion of the secondary coil of the second card and at least the second portion of the secondary coil of the first card overlap;

wherein the second card and the playing piece may be placed on a playing surface so that at least a portion of the receiving coil and at least a second portion of the secondary coil of the second card overlap; and wherein the driving signal initiated at the driving coil may be transmitted through the secondary coils of the first card and the second card and received by the receiving coil.

3. The electronic card game system according to claim 1, wherein:

the driving coil transmits a resonant field primarily on a first side of the initiator; and the first card folds from the first side of the initiator to a second side of the initiator.

4. The electronic card game system according to claim 1, wherein:

the driving coil transmits a resonant field primarily on a first side of the initiator;

the initiator includes a display screen on a second side of the initiator;

the first card folds from the first side of the initiator to the second side of the initiator so that the first card at least partially overlaps the display screen; and the first card is at least partially transparent or cut away so that the display screen may be viewed through the first card as the playing piece is removed from overlapping the second portion of the secondary coil.

5. The electronic card game system according to claim 1, wherein the first card is folded to define a Z-shape.

6. The electronic card game system according to claim 5, wherein the first card is at least partially transparent or cut away so that the initiator may be viewed through the first card.

7. A method for playing an electronic card game system, comprising the following steps:

providing a first card with a first resonant coil;

placing the first card on a playing surface;

providing an initiator with a driving coil;

placing the initiator on the playing surface relative to the first card so that at least a portion of the first resonant coil and the driving coil overlap;

providing a playing piece with a receiving coil;

placing the playing piece on the playing surface relative to the first card so that at least a portion of the first resonant coil and the receiving coil overlap;

initiating a driving signal at the driving coil and relaying the driving signal through the first resonant coil and to the receiving coil;

providing a second card with a second resonant coil;

providing a third card with a third resonant coil;

placing the second card on the playing surface so that a portion of the first resonant coil and a first portion of the second resonant coil overlap;

placing the third card on the playing surface so that a portion of the third resonant coil and a second portion of the second resonant coil overlap;

placing the playing piece on the playing surface relative to the third card so that at least a portion of the third resonant coil and the receiving coil overlap; and initiating the driving signal at the driving coil and relaying the driving signal through the first resonant coil to the second resonant coil, and through the third resonant coil and to the receiving coil.

8. A method for playing an electronic card game system, comprising the following steps:

providing a first card with a first resonant coil;

placing the first card on a playing surface;

providing an initiator with a driving coil;

placing the initiator on the playing surface relative to the first card so that at least a portion of the first resonant coil and the driving coil overlap;

providing a playing piece with a receiving coil;

placing the playing piece on the playing surface relative to the first card so that at least a portion of the first resonant coil and the receiving coil overlap;

initiating a driving signal at the driving coil and relaying the driving signal through the first resonant coil and to the receiving coil;

orienting the initiator so that the driving coil faces the playing surface, and so that a first portion of the first resonant coil is interposed the driving coil and the playing surface;

folding the first card upward from the first portion of the first resonant coil; and further folding the first card so that a second portion of the first resonant coil overlaps the initiator, and so that both the initiator and the first portion of the first resonant coil is interposed the second portion and the playing surface.

9. A method for playing an electronic card game system, comprising the following steps:

providing a first card with a first resonant coil;

placing the first card on a playing surface;

providing an initiator with a driving coil;

placing the initiator on the playing surface relative to the first card so that at least a portion of the first resonant coil and the driving coil overlap;

providing a playing piece with a receiving coil;

placing the playing piece on the playing surface relative to the first card so that at least a portion of the first resonant coil and the receiving coil overlap;

initiating a driving signal at the driving coil and relaying the driving signal through the first resonant coil and to the receiving coil;

orienting the initiator so that the driving coil is distant from the playing surface;

placing the first card so that a first portion of the first resonant coil is above the driving coil relative to the playing surface;

folding the first card downward from the first portion of the first resonant coil; and further folding the first card so that a second portion of the first resonant coil is adjacent the playing surface and extends away from the initiator, and so that the playing piece may be placed on top of the second portion of the first resonant coil, adjacent the initiator.

10. A method for playing an electronic card game system, comprising the following steps:

providing a first card with a first resonant coil;

placing the first card on a playing surface;

providing an initiator with a driving coil;

placing the initiator on the playing surface relative to the first card so that at least a portion of the first resonant coil and the driving coil overlap;

providing a playing piece with a receiving coil;

placing the placing piece on the placing surface relative to the first card so that at least a portion of the first resonant coil and the receiving coil overlap;

initiating a driving signal at the driving coil and relaying the driving signal through the first resonant coil and to the receiving coil;

folding the first card to form a Z-Fold repeater coil card, wherein the first portion of the first resonant coil defines a top flap, and the second portion of the first resonant coil defines a bottom flap;

orienting the initiator so that the driving coil is distant from the playing surface;

placing the first card so that the top flap is above the driving coil relative to the playing surface, and so the bottom flap rests on the playing surface and extends away from the initiator; and orienting the playing piece relative to the bottom flap so that so that the bottom flap is interposed the playing piece and the playing surface, and so that the playing piece is adjacent the initiator.

11. An electronic card game system for use with an initiator having a primary coil capable of generating a radio-frequency signal, comprising:

a playing card having a secondary coil for receiving and retransmitting the radio-frequency signal;

a playing piece having a receiving coil, wherein the playing piece rests on top of the playing card while the primary coil is adjacent the playing card, and wherein the radio-frequency signal may be transmitted through the playing card from the initiator to the playing piece; and a second card having a secondary coil for receiving and retransmitting the radio-frequency signal;

wherein the playing card and the second card partially overlap so that only a portion of the secondary coil of the second card and only a portion of the secondary coil of the playing card overlap;

wherein the second card and the initiator partially overlap so that at least a portion of the primary coil and at least a second portion of the secondary coil of the second card overlap; and wherein the radio-frequency signal may be transmitted through the second card and the playing card from the initiator to the playing piece.

12. The electronic card game system according to claim 11, wherein:

the driving coil transmits a resonant field primarily on a first side of the initiator; and the playing card folds from the first side of the initiator to a second side of the initiator.

13. The electronic card game system according to claim 11, wherein:

the driving coil transmits a resonant field primarily on a first side of the initiator;

the initiator includes a display screen on a second side of the initiator;

the playing card folds from the first side of the initiator to a second side of the initiator so that the playing card at least partially overlaps the display screen; and the playing card is at least partially transparent or cut away so that the display screen may be viewed through the playing card as the playing piece is removed from overlapping the second portion of the secondary coil.

14. The electronic card game system according to claim 11, wherein the playing card is folded to define a Z-shape.

15. The electronic card game system according to claim 14, wherein the playing card is at least partially transparent or cut away so that the initiator may be viewed through the playing card.

16. An electronic card game system for use with an initiator having a primary coil capable of generating a radio-frequency signal, comprising:

a playing card having a secondary coil for receiving and retransmitting the radio-frequency signal;

a playing piece having a receiving coil, wherein the playing piece rests on top of the playing card while the primary coil is adjacent the playing card, and wherein the radio-frequency signal may be transmitted through the playing card from the initiator to the playing piece; and a second card having a secondary coil for receiving and retransmitting the radio-frequency signal, wherein the second card is folded to define a Z-shape;

wherein an upper portion of the second card rests on the initiator;

wherein a lower portion of the second card rests on a playing surface;

wherein only a portion of the secondary coil of the second card and only a portion of the secondary coil of the playing card overlap; and wherein the radio-frequency signal may be transmitted through the second card and the playing card from the initiator to the playing piece.

17. An electronic card game system for use with an initiator having a primary coil capable of generating a radio-frequency signal, comprising:

a playing card having a secondary coil for receiving and retransmitting the radio-frequency signal; and a playing piece having a receiving coil, wherein the playing piece rests on top of the playing card while the primary coil is adjacent the playing card, and wherein the radio-frequency signal may be transmitted through the playing card from the initiator to the playing piece, wherein:

the playing card is a Z-fold repeater coil card including a top portion that is relatively smaller than a bottom portion;

the top portion defines a top flap of a Z-Fold that rests on top of the initiator;

a middle portion of the Z-Fold card runs down a side of the initiator; and the bottom portion extends the radio-frequency signal from the initiator to the playing piece.

* * * * *